US005617915A

United States Patent [19]

Kinugasa et al.

[11] Patent Number: 5,617,915

[45] Date of Patent: Apr. 8, 1997

[54] LAMINATED HEAT EXCHANGER

[75] Inventors: Takashi Kinugasa; Kunihiko Nishishita; Seiji Inoue, all of Konan, Japan

[73] Assignee: Zexel Corporation, Tokyo, Japan

[21] Appl. No.: 609,993

[22] Filed: Feb. 29, 1996

Related U.S. Application Data

[62] Division of Ser. No. 516,151, Aug. 17, 1995.

[30] Foreign Application Priority Data

Aug. 25, 1994 [JP] Japan ..... 6-224204
May 22, 1995 [JP] Japan ..... 7-146717

[51] Int. Cl.[6] ..... F28D 1/03
[52] U.S. Cl. ..... 165/153; 165/176
[58] Field of Search ..... 165/153, 176; 62/515

[56] References Cited

U.S. PATENT DOCUMENTS

| | | | |
|---|---|---|---|
| 4,274,482 | 6/1981 | Sonoda | 165/153 |
| 4,487,038 | 12/1984 | Iijima | 62/515 |
| 5,024,269 | 6/1991 | Noguchi et al. | 165/176 |
| 5,042,577 | 8/1991 | Suzumura | 165/153 |
| 5,355,947 | 10/1994 | Rasso, Jr. et al. | 165/176 |
| 5,413,169 | 5/1995 | Frazier et al. | 165/153 |

FOREIGN PATENT DOCUMENTS

| | | | |
|---|---|---|---|
| 0271084 | 6/1988 | European Pat. Off. . | |
| 267868 | 11/1988 | Japan . | |
| 225954 | 9/1990 | Japan | 62/515 |
| 137493 | 6/1991 | Japan | 165/176 |
| 332353 | 11/1992 | Japan | 62/515 |
| 194001 | 7/1994 | Japan | 62/515 |

*Primary Examiner*—Leonard R. Leo
*Attorney, Agent, or Firm*—Wenderoth, Lind & Ponack

[57] ABSTRACT

A plurality of tube elements, each of which is provided with a pair of tanks on one side with these tanks communicating via a heat exchanging medium passage, are laminated. An intake/outlet tank group with intake/outlet portions is divided into three tank sub groups while a non intake/outlet tank group is not partitioned, constituting a single tank group. The intake/outlet portion on the intake side is directly connected with the tank sub group at one end in the intake/outlet tank group and at the same time, it communicates with the tank sub group at the other end via a relay pipe. Consequently, the coolant that has flowed in through the intake/outlet portion is induced to the non intake/outlet tank group from the tank sub group at one end via a heat exchanging medium passage and it is also induced to the non intake/outlet tank group from the tank sub group at the other end via the heat exchanging medium passage before the two flows are joined at the center. Then, the coolant reaches the tank sub group at the center in the intake/outlet tank group by travelling through the heat exchanging medium passage again to flow out through the intake/outlet portion on the output side. By improving the distribution of the heat exchanging medium, the performance of the heat exchanger is enhanced.

7 Claims, 21 Drawing Sheets

FIG.10A
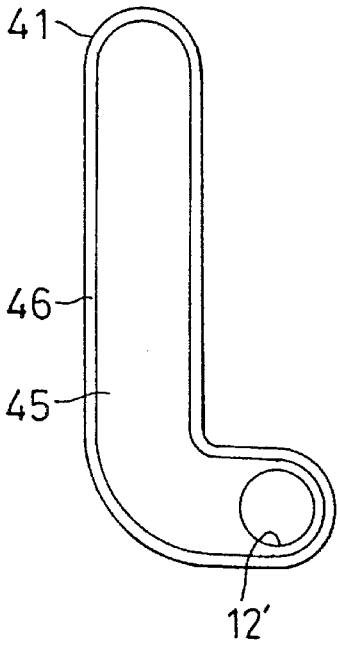
FIG.10B
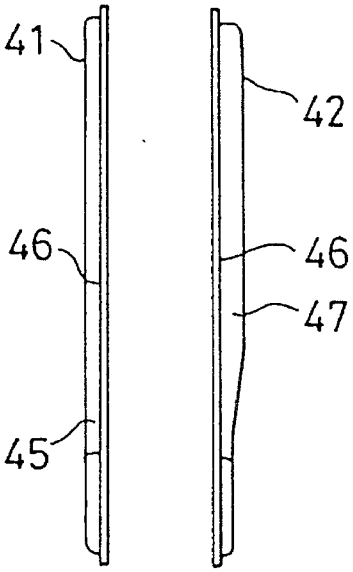
FIG.10C
FIG.10D
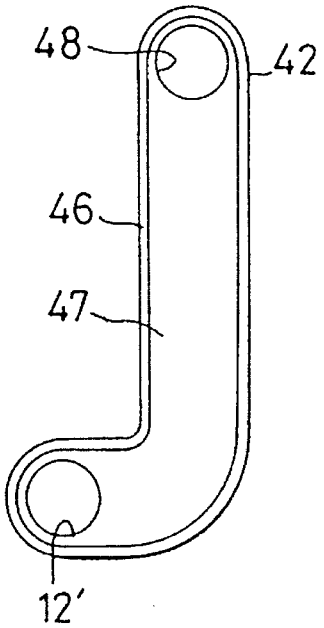
FIG.10E
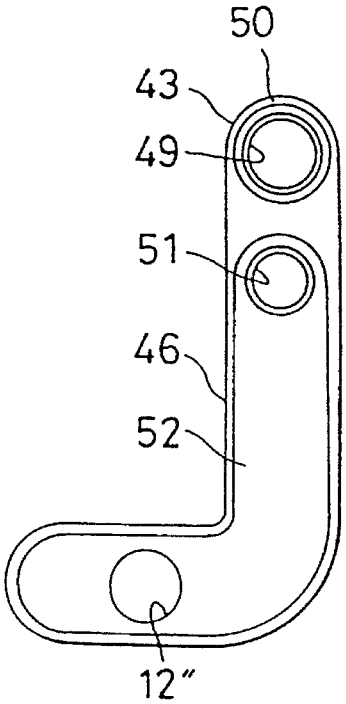
FIG.10F
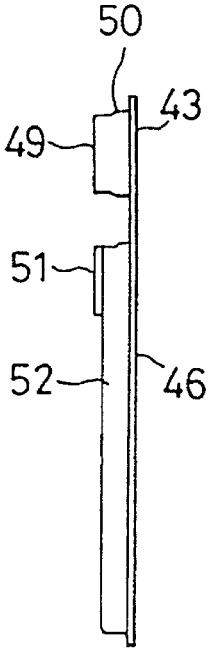
FIG.10G
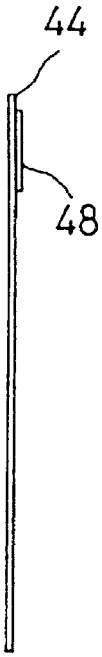
FIG.10H
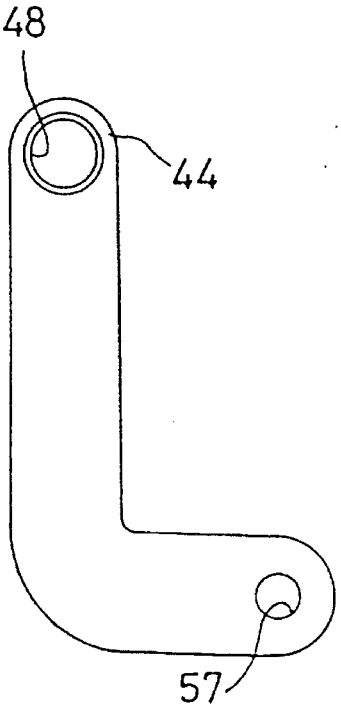

LAMINATED HEAT EXCHANGER

This is a divisional application of Ser. No. 08/516,151, filed Aug. 17, 1995.

BACKGROUND OF THE INVENTION

1. Field of the Invention

The present invention relates to a laminated heat exchanger used, for instance, as a heater core, or an evaporator in an air conditioning system for vehicles.

2. Description of the Related Art

Well known laminated heat exchangers in the prior art include, for instance, the one shown in FIG. 1 of Japanese Unexamined Patent Publication No. S63-267868.

To outline this laminated heat exchanger, an intake piping unit 2A and an outlet piping unit 2B project out adjacent to each other approximately at the center of the front surface in the direction of air flow. The intake piping unit 2A and the outlet piping unit 2B are each formed by bonding formed plates abutted facing each other so that they are internally provided with a first space 40 and a second space 50 and a first space 61 and a second space 71 respectively.

Between the intake piping unit 2A and the outlet piping unit 2B, a central tube unit 9 is provided in such a manner that it is clamped between the two units. The central tube unit 9 is provided with a first space 48 and a second space 58.

The first space 48 of the central tube element 9 and the first space 61 of the outlet piping unit 2B are cut off from each other so that the first space 48 of the intake piping unit 2A and the first space 61 of the outlet piping unit 2B are not in communication. Furthermore, adjacent tanks communicate via holes 704, 705, 904 and 905, which are formed in the direction of the lamination.

With this, the tanks in this laminated heat exchanger are divided into an intake tank group 200, a central tank group 201 and an outlet tank group 202, to effect the flow of heat exchanging medium described below.

First, after the heat exchanging medium flows into the intake piping unit 2A to the first space 40, it travels into the intake tank group 200. The heat exchanging medium in the intake tank group 200 then travels through the first tube group 401 along its U-shaped flow path to flow into the left half of the central tank group 201.

Then, the heat exchanging medium that has flowed into the left half of the central tank group 201 flows into the right half of the central tank group 201 via the second spaces 50 and 71 of the intake piping unit 2A and the outlet piping unit 2B respectively.

The heat exchanging medium, which has thus flowed into the right half of the central tank group 201, flows through the second tube group 402 along its U-shaped flow path. Then it flows into the outlet tank group 202. After that, it flows to the left and flows out from the outlet piping unit 2B.

However, in a laminated heat exchanger provided with tank groups that effect the flow of heat exchanging medium described above, the heat exchanging medium does not flow easily in tanks that are far from the intake and outlet piping units, i.e., the tanks that are at the ends.

This causes inconsistency in the distribution of heat exchanging medium flowing in the laminated heat exchanger, which, in turn, results in poor temperature distribution of the heat exchanging medium flowing in the tube units, reducing the performance of the laminated heat exchanger.

SUMMARY OF THE INVENTION

The object of the present invention is to provide a laminated heat exchanger with enhanced performance which can be achieved by creating new flow paths for the heat exchanging medium to improve the distribution of the heat exchanging medium by addressing the problem described above.

Accordingly, the laminated heat exchanger according to the present invention is constituted by laminating tube elements, each of which is formed by fitting together a pair of formed plates, with a pair of tanks at one end and a heat exchanging medium passage that communicates between the pair of tanks, alternately with fins over a plurality of levels, with the pairs of tanks formed, by lamination, to constitute separate tank groups, i.e., an intake/outlet tank group and a non intake/outlet tank group. The intake/outlet tank group is further divided into three tank sub groups by two non communicating portions while the non intake/outlet tank group constitutes one tank group which is in communication throughout with no partitions. One intake/outlet portion is provided in one of the tank sub groups that is at one end of the intake/outlet tank group and is connected to the tank sub group at the other end via a means for relay. The other intake/outlet portion is provided in the tank sub group which is in the center of the intake/outlet tank group.

In the laminated heat exchanger structured as described above, heat exchanging medium flows into the tank sub groups at both ends in the intake/outlet tank group from the one intake/outlet portion, then travels upwards from the intake/outlet tank sub groups at both ends through heat exchanging medium passage groups at both ends. It then travels downward through the heat exchanging medium passage groups and the two flow paths of the heat exchanging medium are joined at the non intake/outlet tank group to travel upward from the center of the non intake/outlet tank group through the heat exchanging medium passage group. It then travels downward through the heat exchanging medium passage group to reach the central tank sub group of the intake/outlet tank group and flows out through the other intake/outlet portion.

Another example of the laminated heat exchanger according to the present invention is constituted by laminating tube elements, each of which is formed by fitting together two formed plates, with a pair of tanks at one end and a heat exchanging medium passage that communicates between the pair of tanks, alternately with fins over a plurality of levels, with the pairs of tanks formed, by lamination, to constitute separate tank groups, i.e., an intake/outlet tank group and a non intake/outlet tank group. The intake/outlet tank group is further divided into three tank sub groups by two non communicating portions while the non intake/outlet tank group is further divided into two tank sub groups by one non communicating portion provided in the tube element located between the two non communicating portions. One intake/outlet portion is provided in one of the tank sub groups that is at one end of the intake/outlet tank group and is connected to the tank group at the other end via a means for relay. The other intake/outlet portion is provided in the tank sub group which is in the center of the intake/outlet tank group.

In the laminated heat exchanger structured as described above, heat exchanging medium flows, for instance, from the one intake/outlet portion into the tank sub groups at both ends of the intake/outlet tank group, then travels upwards from the intake/outlet tank sub groups at both ends through heat exchanging medium passage groups at both ends. It then travels downward through the heat exchanging medium passage groups and the two flow paths of the heat exchanging medium flow separately into the left tank sub group and the right tank sub group of the non intake/outlet tank group. The two flow paths of the heat exchanging medium then travel upward from those tank sub groups through the two heat exchanging medium passage groups in the center which are separate from each other. They then travel downward through the two heat exchanging medium passage groups to reach the central tank sub group of the intake/outlet tank group to be joined, before flowing out from the other intake/outlet portion.

Yet another example of the laminated heat exchanger which achieves a improved distribution of heat exchanging medium is constituted by laminating tube elements, each of which is formed by fitting together two formed plates, with a pair of tanks at one end and a heat exchanging medium passage that communicates between the pair of tanks, alternately with fins over a plurality of levels, with an intake/outlet tank group provided with intake/outlet portions and a non intake/outlet tank group which forms a pair with the intake/outlet tank group formed separately by the lamination of the tanks, and a passage formed between the intake/outlet tank group and the non intake/outlet tank group. The intake/outlet tank group is divided into two tank sub groups with a non communicating portion provided at approximately the center in the direction of lamination, while the non intake/outlet tank group constitutes one tank group which is in communication throughout, with no partitions. A pair of intake/outlet portions are provided in close proximity across the non communicating portion at approximately the center of the intake/outlet tank group and the intake/outlet portions are each constituted as one with the tube element or constituted separate from the tube element with a 2-way split pipe, with at least, the intake side of the intake/outlet portions in communication with a tank away from the non communicating portion via a relay pipe provided within the passage.

In the laminated heat exchanger structured as described above, heat exchanging medium which flows in through an intake/outlet portion constituted as one with a tube element or constituted separate from the tube element with a 2-way split pipe, then directly flows into the intake/outlet tank sub group on the intake side and it also flows in from another direction via the relay pipe so that it can travel through the entirety of the intake side. It then travels upward through the heat exchanging medium passage group which communicates with the intake side to reach the non intake/outlet tank group. The heat exchanging medium then moves to the remaining tube elements in the non intake/outlet tank group, travels upward through the heat exchanging medium passage group again to reach the intake/outlet tank group and flows out from the intake/outlet portion on the outlet side.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings:

FIGS. 10A–10H illustrate plates for intake/outlet portion formation which constitute the intake/outlet portions in the laminated heat exchanger above;

DETAILED DESCRIPTION OF THE PREFERRED EMBODIMENTS

The following is an explanation of the embodiments according to the present invention with reference to the drawings.

FIGS. 1–11 show a first embodiment of a laminated heat exchanger 1 according to the present invention.

Figure 1:
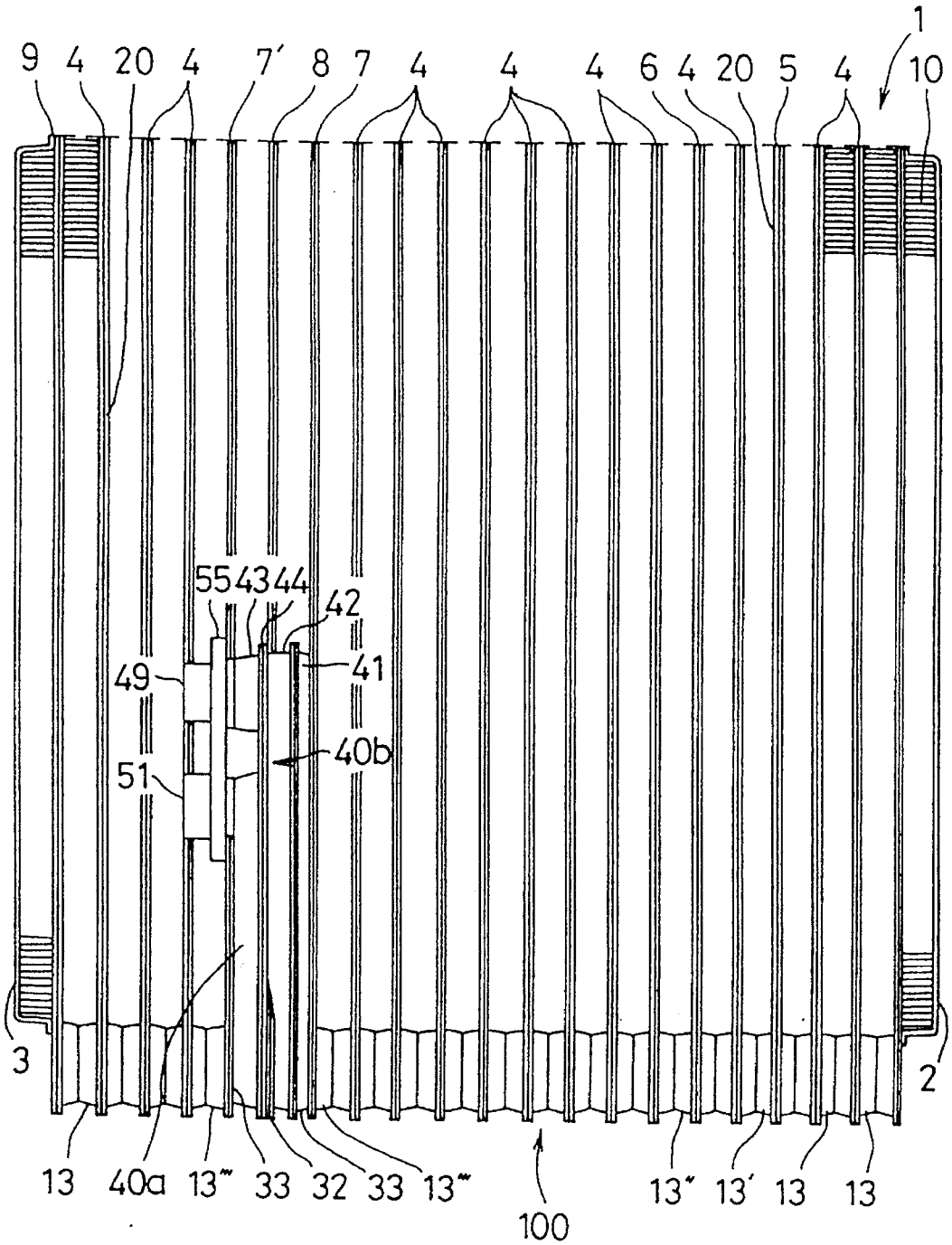
FIG. 1 illustrates the overall structure of the laminated heat exchanger in a first embodiment according to the present invention.
Figure 2:
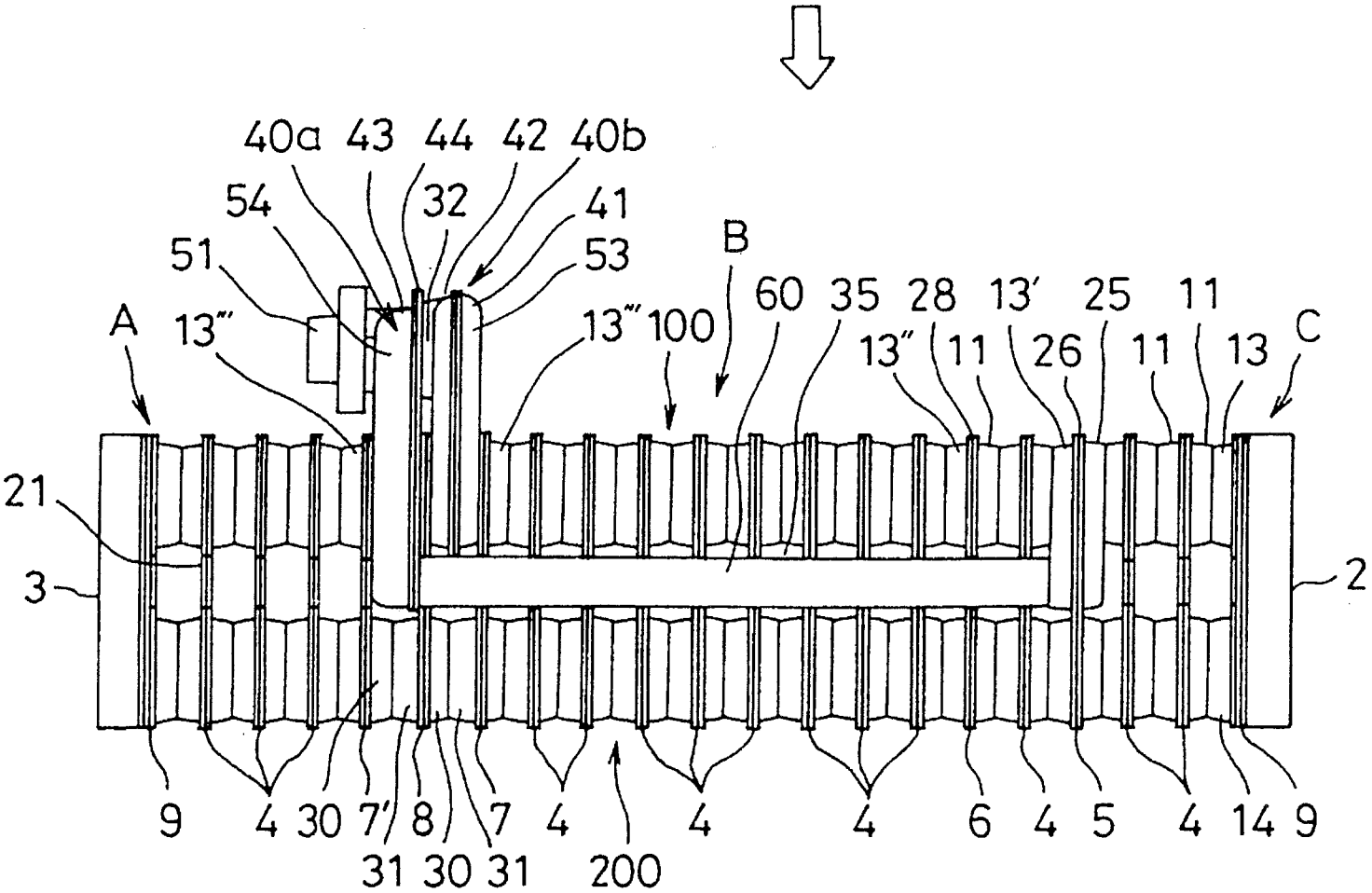
FIG. 2 illustrates the laminated heat exchanger of FIG. 1 viewed from an end with tanks.
Figure 3:
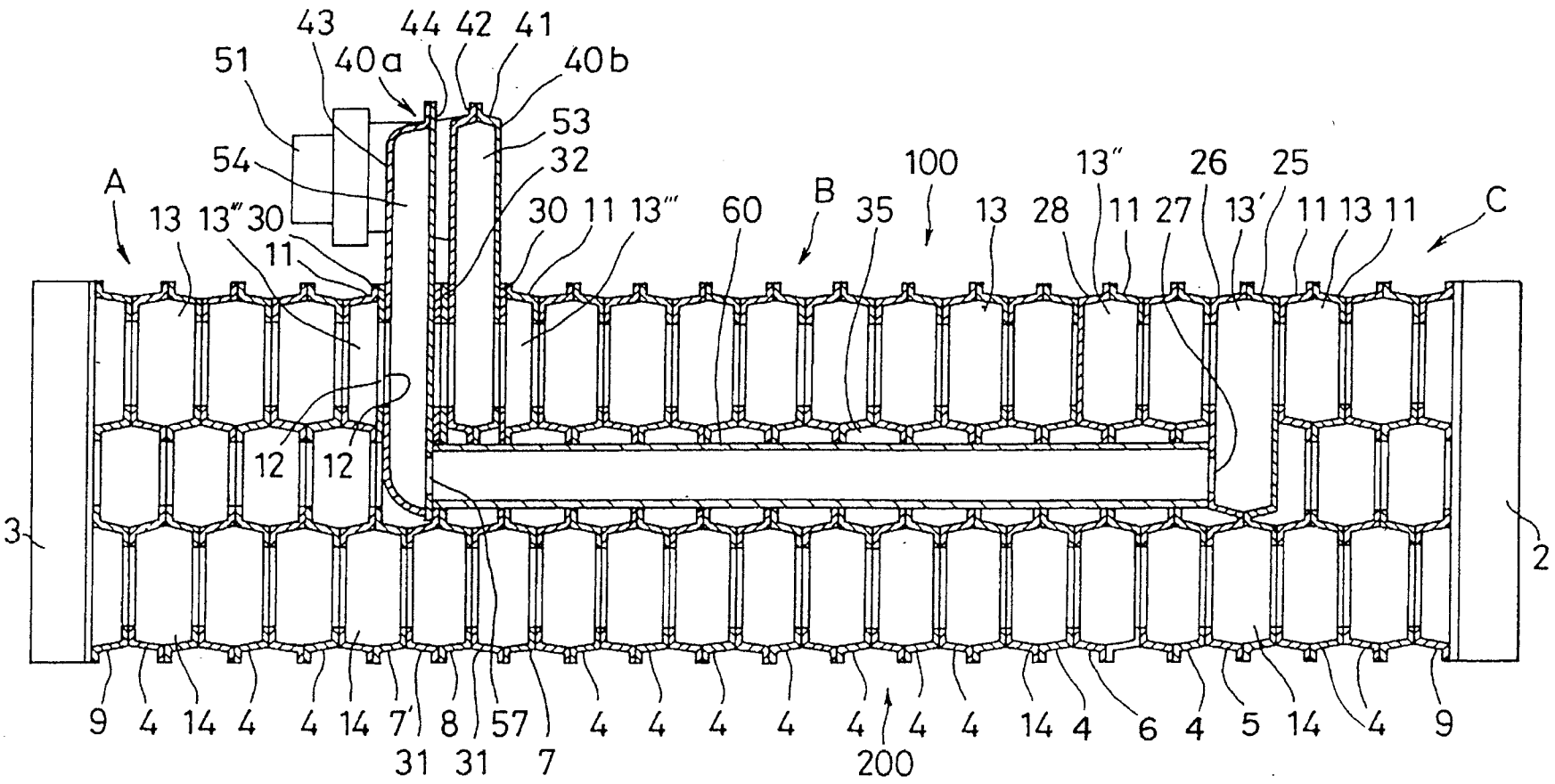
FIG. 3 is a cross section of the laminated heat exchanger of FIG. 1 at the end with the tanks.

As shown in FIGS. 1 and 2, this laminated heat exchanger 1 is constituted by laminating a plurality of types of tube elements 4, 5, 6, 7, 7', 8 and 9 and corrugated fins 10 alternately over a plurality of levels (21 levels, for instance). The core of the heat exchanger is formed by providing the second tube element 5 between the laminated first tube elements 4 at the seventh from the center, providing the third tube element 6 at the second place counting toward the center from the second tube element 5, and providing the fourth tube element 7, the sixth tube element 8 and the fifth tube element 7', located fourth, fifth and sixth respectively from the center toward the left. At the same time, a seventh tube element 9 and an end plate 2 or 3, are provided at each end in the direction of the lamination.

Plates for intake/outlet portion formation 41, 42, 43 and 44 which constitute intake/outlet portions 40*a*, 40*b* to be explained later, are provided between the fourth tube element 7 and the sixth tube element 8 and between the sixth tube element 8 and the fifth tube element 7'.

Figure 4:
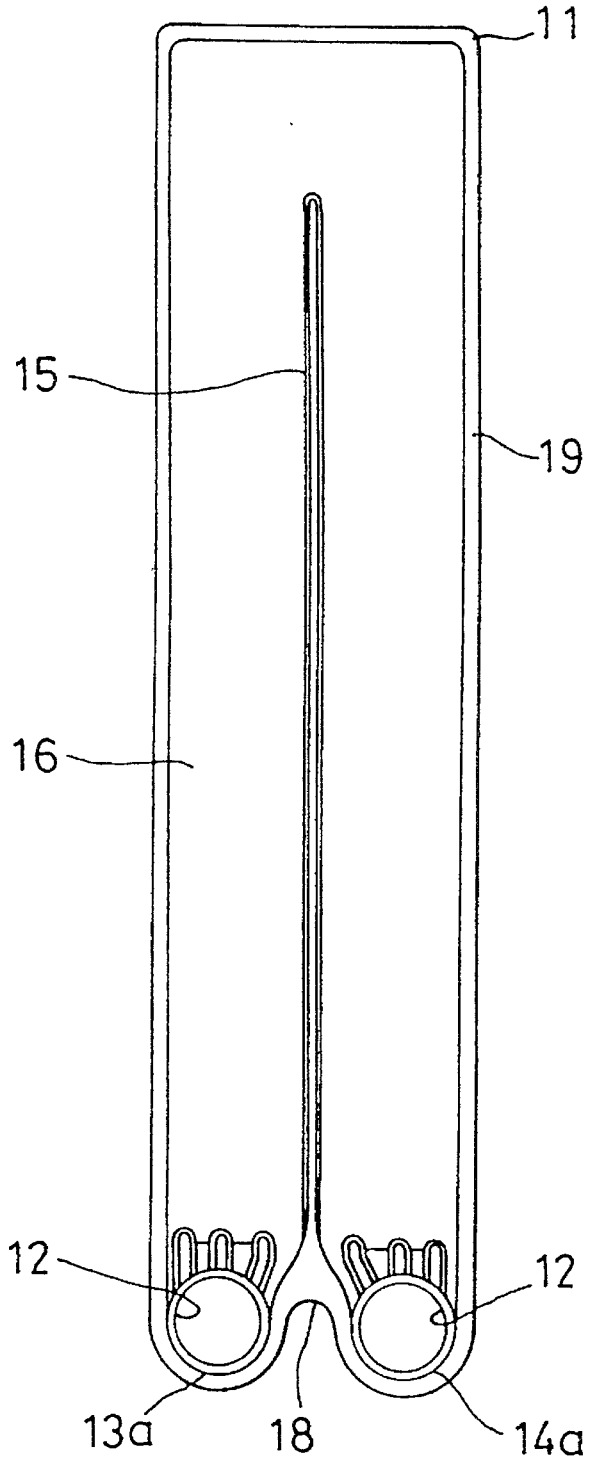
FIGS. 4–9 illustrate the formed plates used in the laminated heat exchanger above.

The first tube element 4, the second tube element 5, the third tube element 6, the fourth tube element 7, the fifth tube element 7', the sixth tube element 8 and the seventh tube element 9 are all approximately rectangular and the first tube element 4 is constituted by two adjoining formed plates 11 and 11, shown in FIG. 4, face-to-face at their brazing margins, 19 and 19.

The formed plates 11 which constitute the first tube element 4 are constituted of a clad material whose main constituent is aluminum, which is clad with brazing material. As shown in FIG. 4, each formed plate 11 is provided with a pair of distended portions for tank formation 13*a* and 14*a* located toward one end in the direction of the length, each of which, in turn, is provided with a communicating hole 12. A projection 15 extends from approximately the center between the distended portions for tank formation 13*a* and 14*a* toward the non-tank side and a distended portion for passage formation 16, which is formed approximately U-shaped and which communicates with the distended portions for tank formation 13*a* and 14*a*, is formed around the projection 15. In addition, an indented portion 18, which is indented toward the inside is formed between the distended portion for tank formation 13*a* and the distended portion for tank formation 14*a*.

The first tube element 4 is constituted by bonding the two formed plates 11 described above, abutted to each other flush. Toward one end of the first tube element 4, a pair of tanks 13 and 14 are formed, constituted of the distended portions for tank formation 13*a* and 14*a* which face opposite each other. Toward the inside, a heat exchanging medium passage 20, which is approximately U-shaped, is constituted by two of the distended portions for passage formation 16 facing opposite each other. The tank 13 and the tank 14 communicate via the heat exchanging medium passage 20 and between the tank 13 and the tank 14, a groove 21 is constituted with the indented portion 18.

Figure 5:
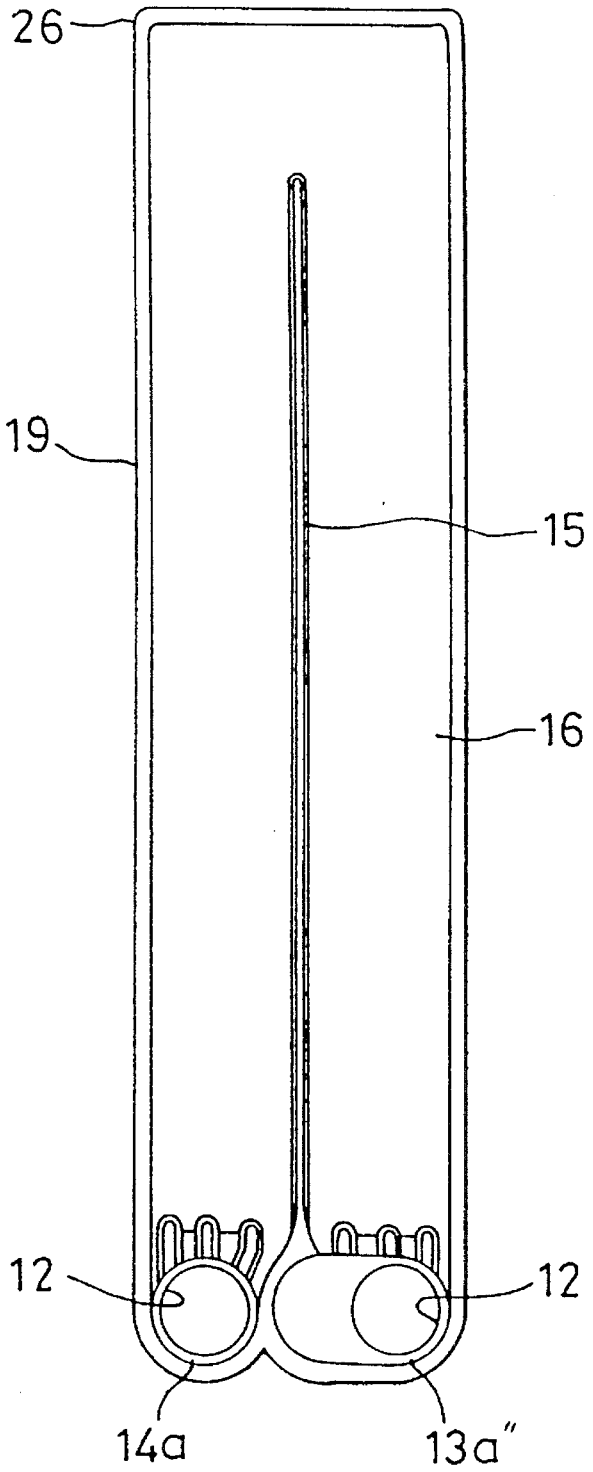
Figure 6:
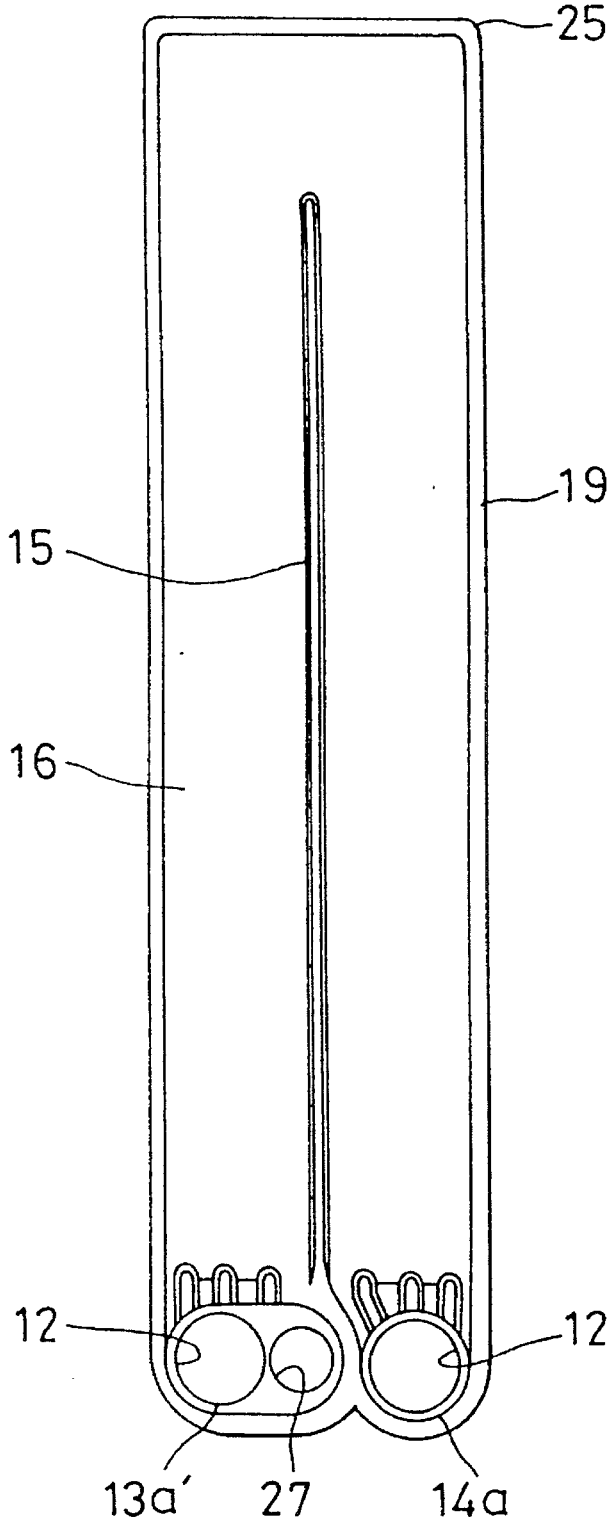

The second tube element 5, which is provided at a position that is third from the end plate 2 of the laminated heat exchanger 1, is constituted by bonding a formed plate 25, shown in FIG. 5, and a formed plate 26, shown in FIG. 6, abutted flush to each other.

The formed plate 25 is similar to the formed plate 11 in its basic form and material. However, it does not have the indented portion 18 between its distended portion for tank formation 13*a*' and its distended portion for tank formation 14*a*. Instead, the distended portion for tank formation 13*a*', which is provided with a fitting hole 27 for fitting a relay pipe 60 and a communicating hole 12, distends into the area where the indented portion would otherwise be, to form an elongated circular shape. The other formed plate 26, too, is similar to the formed plate 11 in its basic form and material. However, it also does not have an indented portion. Instead, the distended portion for tank formation 13*a*", which is provided with a communicating hole 12, distends to the area where the indented portion would otherwise be, to form an elongated circular shape.

The second tube element 5 is constituted by abutting the formed plate 25 and the formed plate 26 flush to each other, and toward its lower end, the tanks 14 are formed from the distended portions for tank formation 14*a* and 14*a* which face opposite each other. At the same time, a tank 13' is constituted from the distended portion for tank formation 13*a*' of the formed plate 25 and the distended portion for tank formation 13*a*" of the formed plate 26. Note that the fitting hole 27 of the tank 13' opens toward a passage 35, to be explained later.

Figure 7:
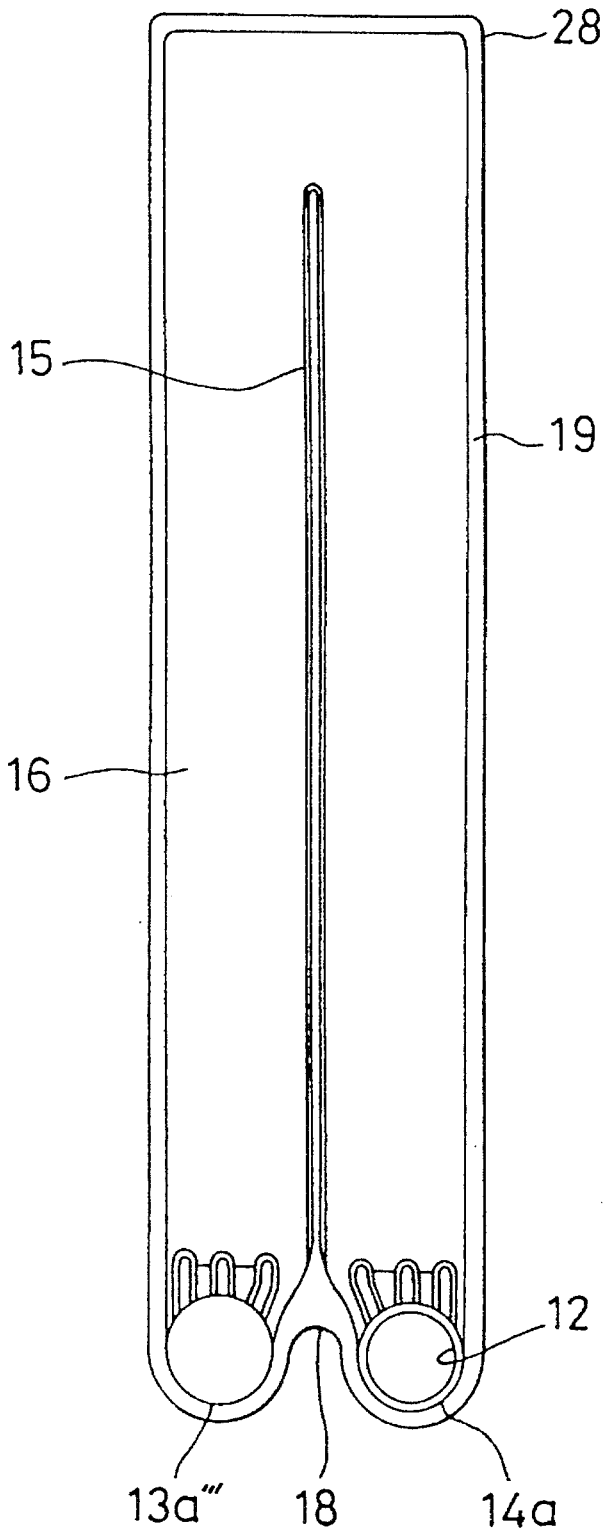

The third tube element 6, which is provided at a position that is second toward the center from the second tube element 5, is constituted by bonding the formed plate 11 shown in FIG. 4 abutted flush to a formed plate 28, shown in FIG. 7, whose distended portion for tank formation 13*a*'" is not provided with a communicating hole 12 but only with a shallow impression.

The third tube element 6 is constituted by abutting the formed plate 28 and the formed plate 11 flush to each other, and toward its lower end, a tank 14 is formed from the distended portions for tank formation 14*a* and 14*a* which face opposite each other. A blind tank 13" is constituted from the distended portion for tank formation 13*a* of the formed plate 11 and the distended portion for tank formation 13*a*'" of the formed plate 28. With this, since the communicating holes 12 do not communicate between the first tube elements 4 and 4 which clamp the third tube element 6, heat exchanging medium does not flow through.

Figure 8:
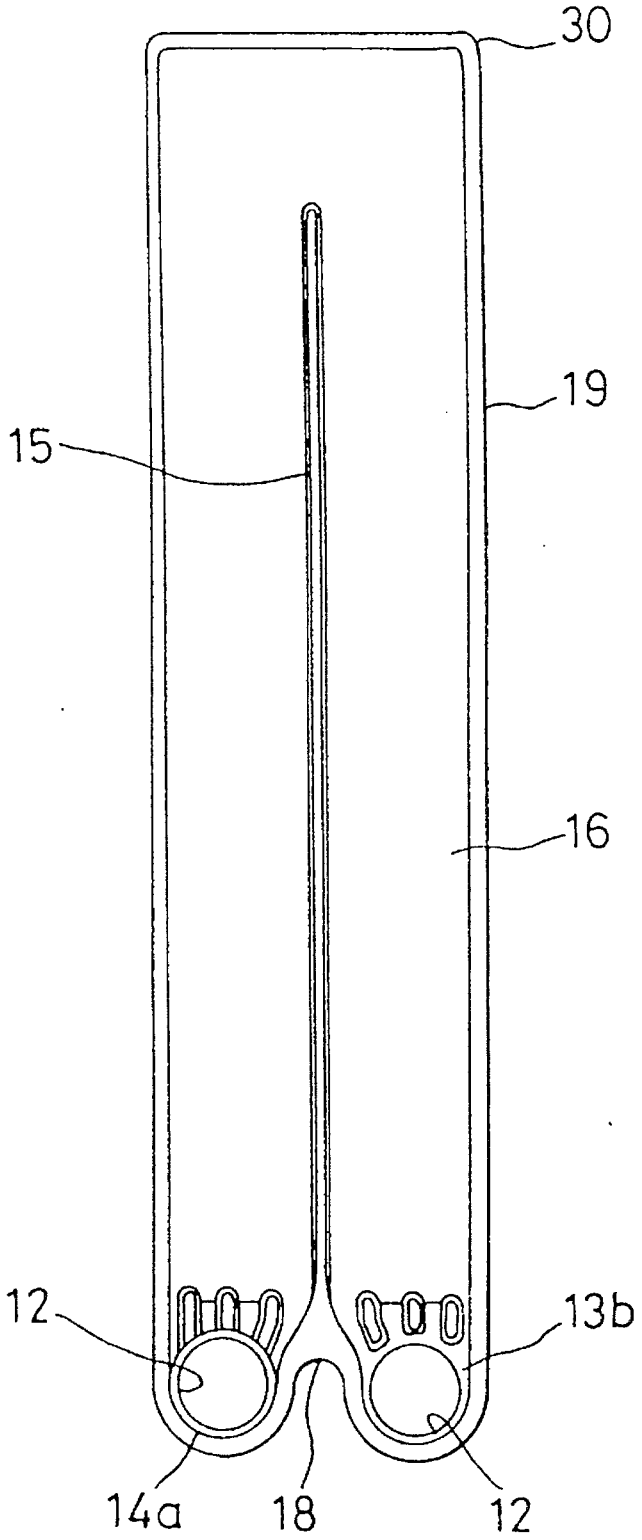

The fourth tube element 7, which is provided at a position that is fourth toward thee end plate 3 from the central tube element 4, is constituted by bonding flush to each other the formed plate 11, shown in FIG. 4, and a formed plate 30, shown in FIG. 8, which is provided with a communicating hole 12 and a flat plate portion 13*b* that does not have a distended portion for tank formation.

Figure 9:
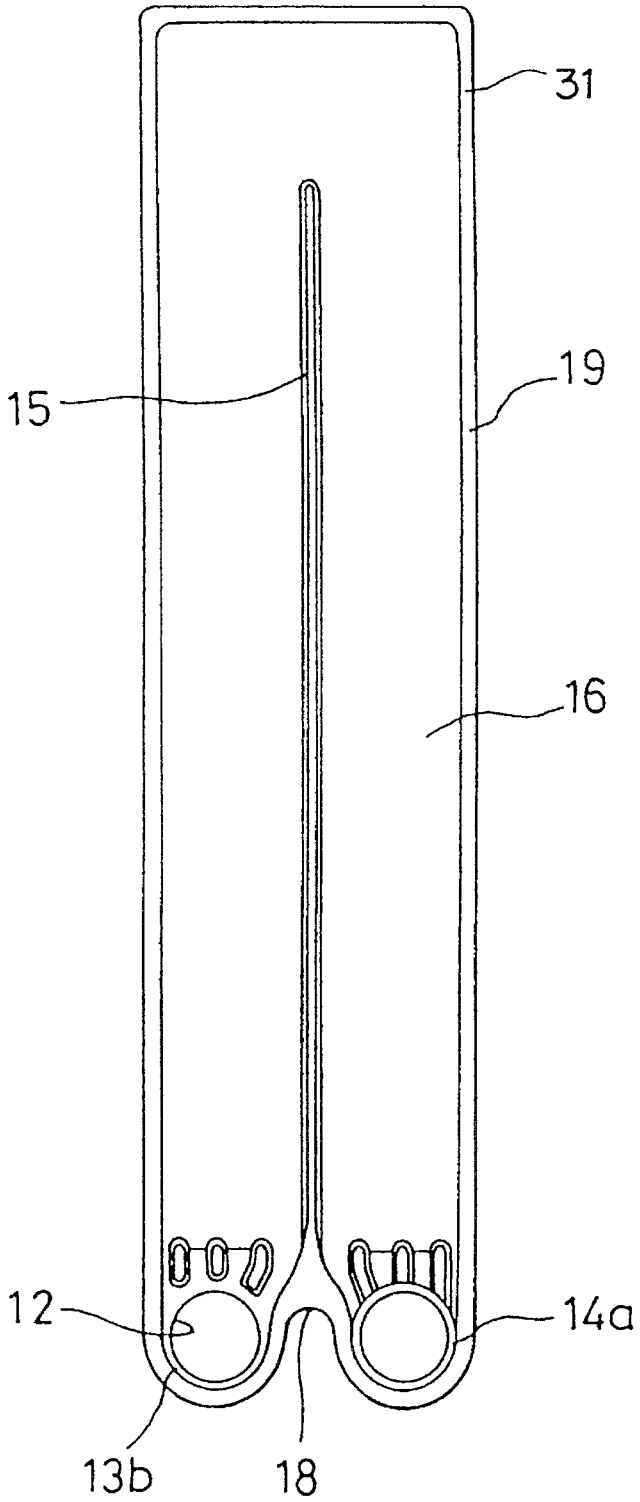
Figure 11:
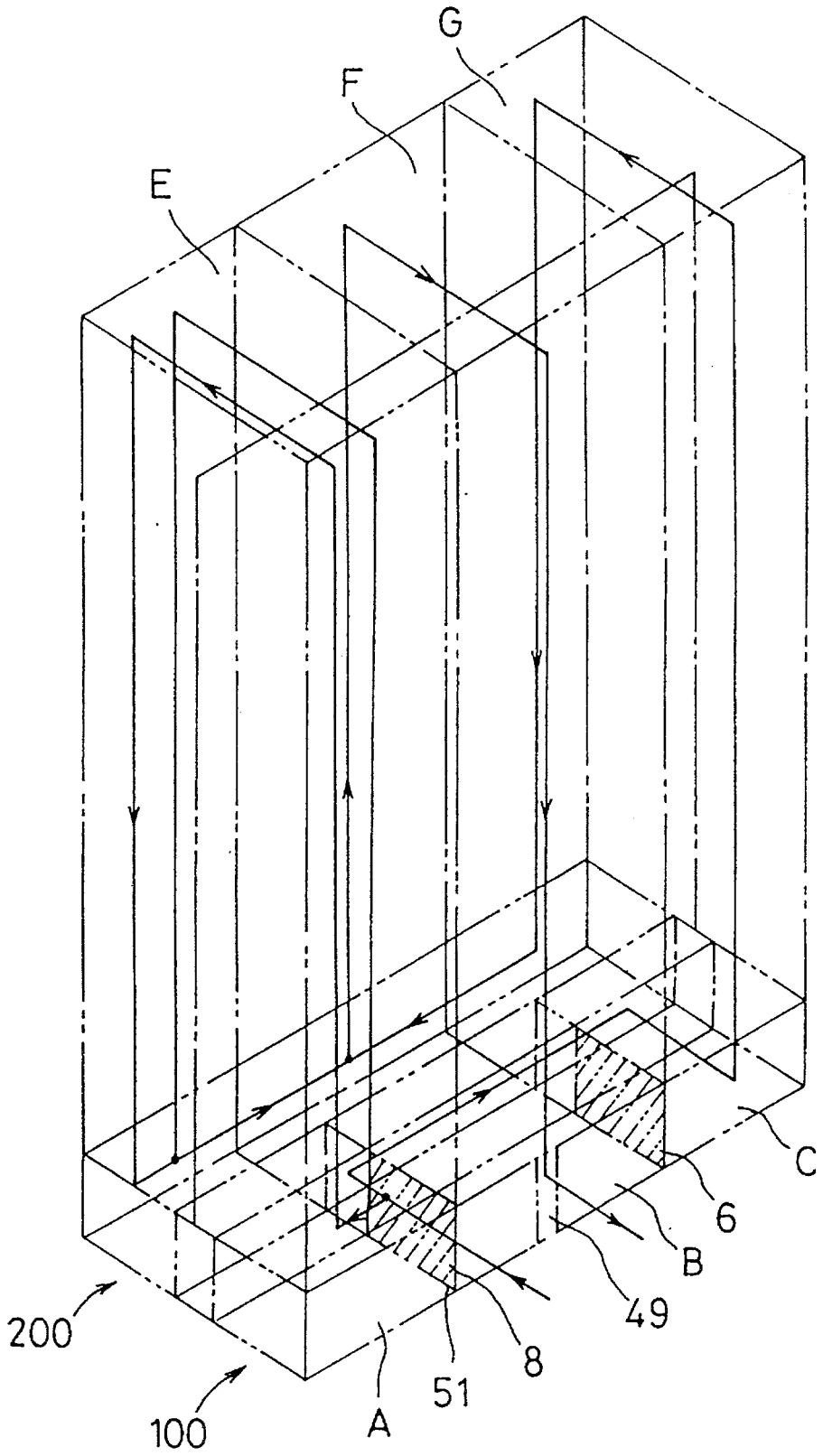
FIG. 11 illustrates the flow of heat exchanging medium in the laminated heat exchanger of FIG. 1.

The fifth tube element 7', which is provided at the sixth position toward the end plate 3 from the central tube element 4, is constituted by bonding flush to each other the formed plate 11 shown in FIG. 4 and a formed plate 31, shown in FIG. 9, which is provided with a communicating hole 12 and a flat plate portion 13*b* that does not have a distended portion for tank formation. In other words the fifth tube element 7' is a mirror image of the fourth tube element 7.

The fourth tube element 7 is constituted by bonding the formed plate 30 and the formed plate 11 flush to each other and the fifth tube element 7' is constituted by bonding the formed plate 31 and the formed plate 11 flush to each other. As shown in FIG. 2, half-tanks 13'" are formed in the fourth tube element 7 and the fifth tube element 7'.

The sixth tube element 8, which is provided between the fourth tube element 7 and the fifth tube element 7' is constituted by bonding the formed plate 30 and the formed plate 31 flush to each other.

By bonding these formed plates 30 and 31 flush to each other, a straight flat plate 32, which is provided with no tanks but is provided only with a communicating hole 12, is formed toward the front surface in the direction of the air flow at the sixth tube element 8, as shown in FIG. 2.

Note that the seventh tube element 9 is constituted by blocking off the formed plate 11 with a flat plate.

Consequently, when the core of the heat exchanger is formed by laminating the first tube elements 4, the second tube element 5, the third tube element 6, the fourth tube element 7, the fifth tube element 7' and the sixth tube element 8 alternately with the fins 10 over a plurality of levels, and by providing the seventh tube element 9 and the end plates 2 and 3 at the two ends, a passage 35 that extends in the direction of the lamination is formed and also, two spaces, to be explained below, which enclose two intake/outlet portions 40*a*, 40*b* are formed.

The intake/outlet portions 40*a* and 40*b* are constituted by bonding together the four plates for intake/outlet portion formation 41, 42, 43 and 44, which form an approximate L-shape, in that order in the direction of the lamination. As shown in FIGS. 10A and 10B, the plate for intake/outlet portion formation 41 is provided with a distended portion for passage formation 45 that is, in turn, provided with a communicating hole 12 located toward the bottom portion to communicate with the communicating hole 12' of the fourth tube element 7 and it is also provided with a brazing margin 46 to come in contact with the plate for intake/outlet portion formation 42 at its peripheral edge.

The plate for intake/outlet portion formation 42 is formed approximately symmetrically to the plate for intake/outlet portion formation 41 as shown in FIGS. 10C and 10D, except that its distended portion for passage formation 47 becomes deeper toward the top and another communicating hole 48 is formed toward the upper end of the distended portion for passage formation 47.

A heat exchanging medium passage 53 is formed when the plate for intake/outlet portion formation 41 and the plate for intake/outlet portion formation 42 are abutted flush to each other. This heat exchanging medium passage 53 has a width which allows its lower end portion to fit between the fourth tube element 7 and the sixth tube element 8 while its upper end portion distends toward the end plate 3 rather than toward the sixth tube element 8.

The plate for intake/outlet portion formation 43, as shown in FIGS. 10E and 10F, is provided with a distended portion 50 with an intake/outlet hole 49 and a distended portion for passage formation 52 with an intake/outlet hole 51. At the lower end of the distended portion for passage formation 52, a communicating hole 12" is provided, which communicates with the communicating hole 12 of the fourth tube element 7.

As shown in FIGS. 10G and 10H, the plate for intake/outlet portion formation 44 is an approximately flat plate, which blocks off the distended portion for passage formation 52 of the plate for intake/outlet portion formation 43. The plate for intake/outlet portion formation 44 is provided with a communicating hole 48 for communicating between the intake/outlet hole 49 of the plate for intake/outlet portion formation 43 and the communicating hole 48 of the plate for intake/outlet portion formation 42, and a fitting hole 57, into which the relay pipe to be described below, is fitted. However, it is not provided with a communicating hole 12.

A heat exchanging medium passage 54 is formed when the plate for intake/outlet portion formation 43 and the plate for intake/outlet portion formation 44 are bonded flush to each other. This heat exchanging medium passage 54 has a width which allows its lower end portion to fit between the sixth tube element 8 and the fifth tube element 7'.

Consequently, when the intake/outlet portions 40*a* and 40*b* are assembled, the intake/outlet hole 49, the distended portion 50 and the heat exchanging medium passage 53 communicate with the tank 13''' of the fourth tube element 7, and the intake/outlet hole 51 and the heat exchanging medium passage 54 communicate with the tank 13''' of the fifth tube element 7'. Note that a block-type mounting plate for an expansion valve (not shown) can be connected on the side where the intake/outlet holes 49 and 51 of the intake/outlet portion 40*a* are provided.

In the structure described above, the laminated heat exchanger 1 is divided by the separated tanks 13 and 14, into an intake/outlet tank group 100 and a non intake/outlet tank group 200. The intake/outlet tank group 100 is further divided into three tank sub groups A, B and C by the third tube element 6 which is provided with a non communicating portion and the plate for intake/outlet portion formation 44. Note that the non intake/outlet tank group 200 constitutes one tank group with all the tanks 14 communicating with one another.

As a result, since the intake/outlet tank group 100 is divided into three portions and the non intake/outlet tank group 200 is in communication throughout, the heat exchanging medium passage is also divided into three heat exchanging medium passage sub groups E, F and G. By giving the laminated heat exchanger 1 such a split structure, heat exchanging medium flowing in from the intake/outlet hole 51 travels through two major flow paths.

The first flow path for the heat exchanging medium has the heat exchanging medium flowing in from the intake/outlet hole 51 and then being sent from the heat exchanging medium passage 54 to the tank sub group A, which is partitioned by a great number of first tube elements 4 and the plate for intake/outlet portion formation 44 of the intake/outlet tank group 100. In this first path, the heat exchanging medium then travels upward through the heat exchanging medium passage sub group E of the first tube elements 4 constituting the tank sub group A. Then it travels downward before reaching the left end of the non intake/outlet tank group 200. Since this non intake/outlet tank group 200 constitutes one tank group, the heat exchanging medium that has flowed in, travels inside the tanks to reach the center, and then from the tank group between the third tube element 6 and the sixth tube element 8, travels upward through the heat exchanging medium passage sub group F. It then travels downward before reaching the tank sub group B of the intake/outlet tank group 100. The tank sub group B is provided with the intake/outlet hole 49 of the intake/outlet portion 40*b* and the heat exchanging medium flows out through this intake/outlet hole 49.

Now, the flow of heat exchanging medium through the second flow path has the heat exchanging medium flowing in from the intake/outlet hole 51, and then travelling through the relay pipe 60 from the heat exchanging medium passage 54 to enter the tank sub group C which is partitioned by the third tube element 6. The heat exchanging medium that has entered the tank sub group C first travels upward and then downward through the heat exchanging medium passage sub group G, and reaches the right end of the non intake/outlet tank group 200. The heat exchanging medium which has thus flowed into the non intake/outlet tank group 200 flows through the tanks until it reaches the center. It then joins the first flow path of heat exchanging medium described earlier and, together, they travel first upward and then downward through the heat exchanging medium passage sub group F before reaching the tank sub group 13 of the intake/outlet tank group 100, to flow out through the intake/outlet hole 49. This means that the flow of heat exchanging medium constitutes a so-called 6-pass flow.

While the explanation has been given with the assumption that the heat exchanging medium flows in through the intake/outlet hole 51 and out through the intake/outlet hole 49, the flow is not limited to that direction. The heat exchanging medium may enter through the intake/outlet hole 49 and flow out through the intake/outlet hole 51. In that case, the flow of the heat exchanging medium will run in the opposite direction from the arrows in FIG. 11.

Figure 12:
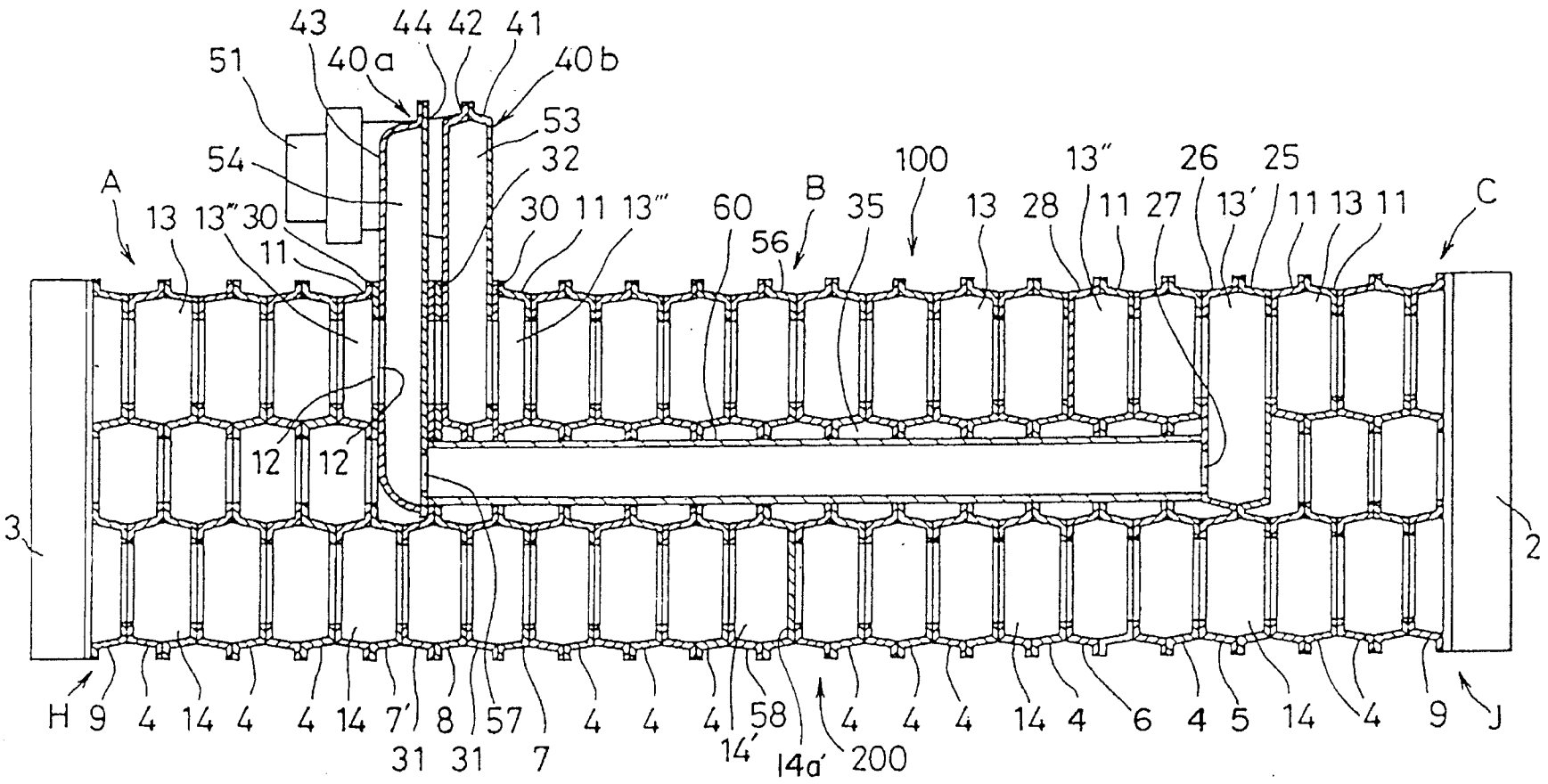
FIG. 12 illustrates the laminated heat exchanger in a second embodiment according to the present invention, viewed from an end with tanks.
Figure 13:
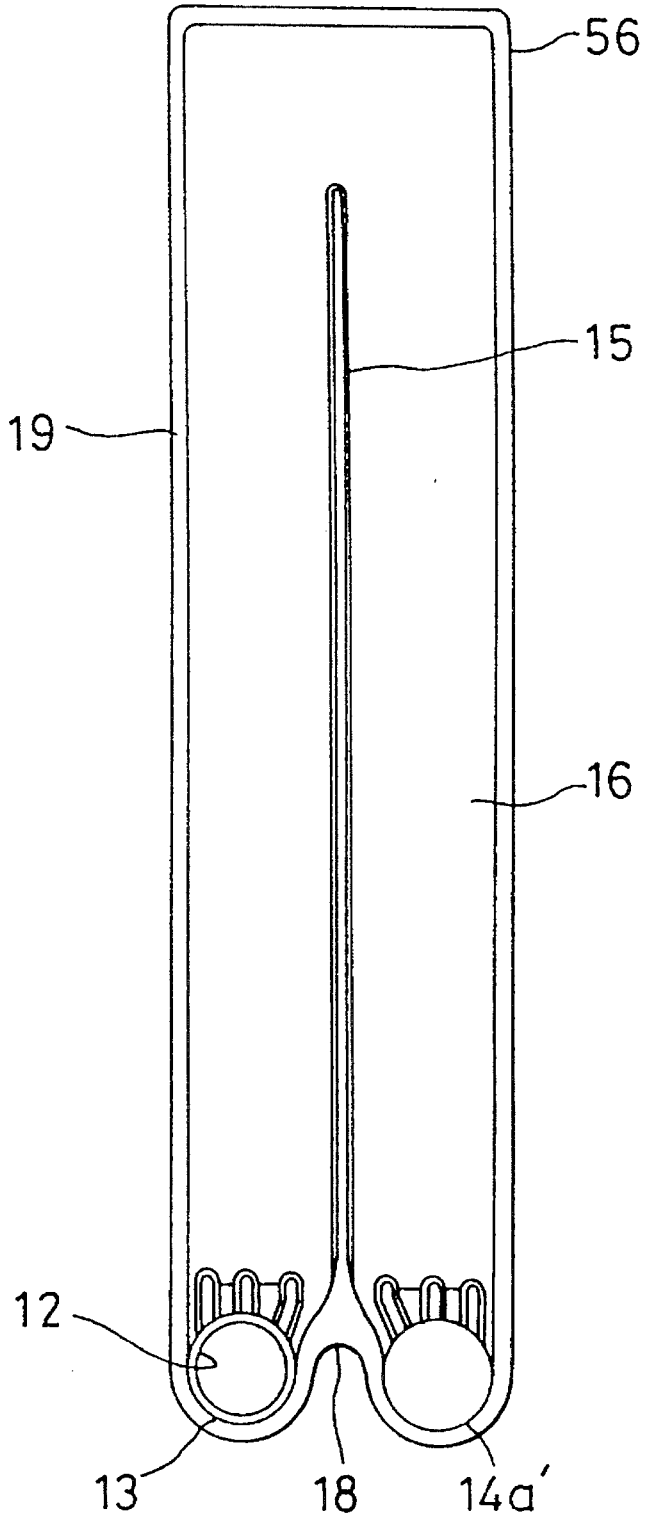
FIG. 13 illustrates formed plates used in the laminated heat exchanger above.
Figure 14:
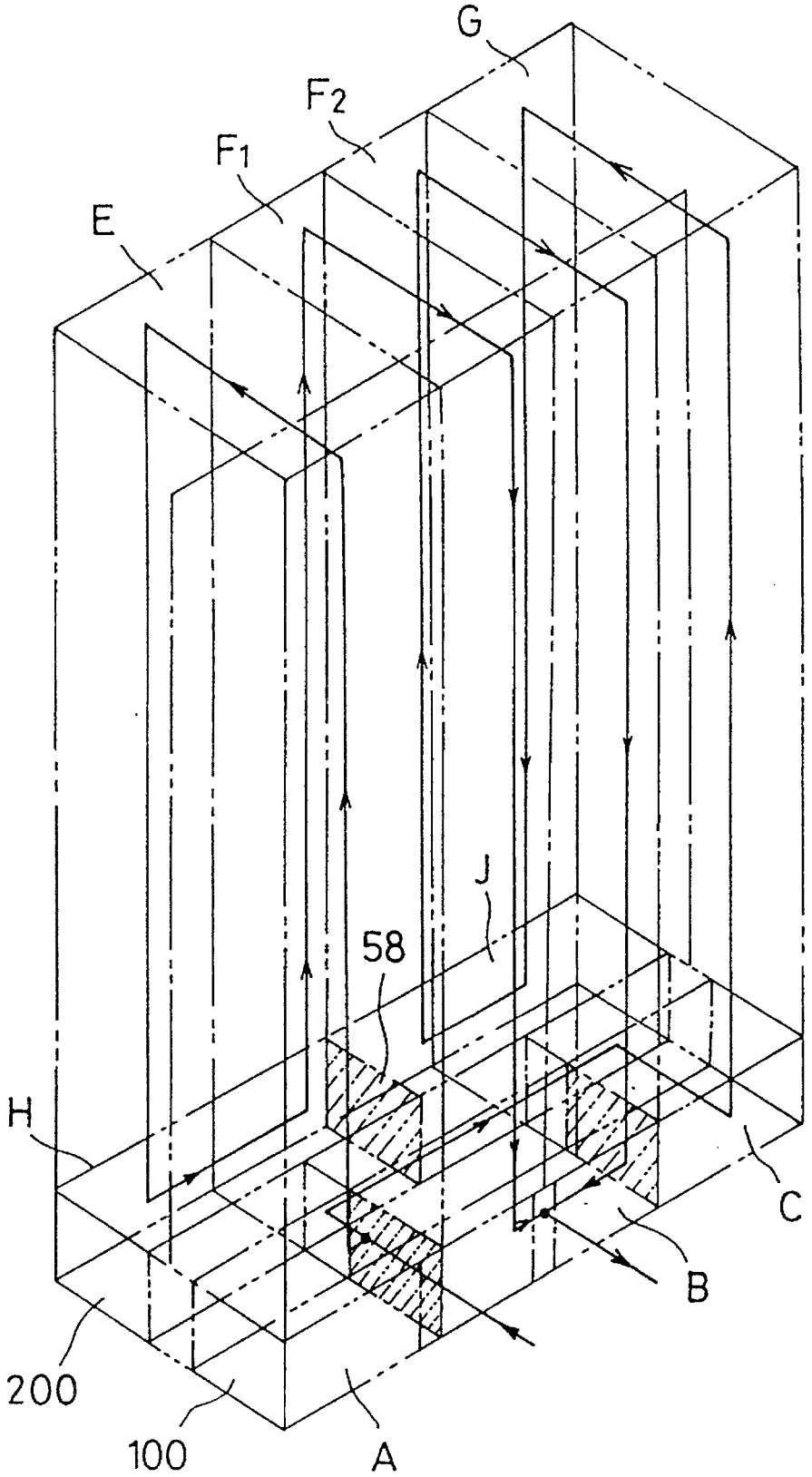
FIG. 14 illustrates the flow of heat exchanging medium in the laminated heat exchanger above.

Next, as a second embodiment of the present invention, the laminated heat exchanger 1 which is structured so that the two flows of heat exchanging medium run separately from beginning to end, effected by using an eighth tube element 58, is explained in reference to FIGS. 12–14. Note that the structures of the first through seventh tube elements, the end plates, the intake/outlet portions and the relay pipe are identical to those described earlier, and that the same reference numbers are assigned to them. Therefore, their explanation is omitted here.

As shown in FIG. 12, the eighth tube element 58 is provided, for instance, at a central position in the direction of lamination, and is structured by bonding the formed plate 11, shown in FIG. 4, and a formed plate 56, shown in FIG. 13, flush to each other.

The formed plate 56 is provided in such a manner that it is positioned at the center in the direction of lamination of the laminated heat exchanger 1 and its basic form is similar to that of the formed plate 11 except that it is provided with no communicating hole 12 at the distended portion for tank formation 14*a'* but is provided with a shallow impression. In other words, it is a mirror image of the third tube element 6 described earlier.

The eighth tube element 58 is constituted by abutting the formed plate 56 and the formed plate 11 flush to each other, and toward its lower end, the tanks 13 are formed from the distended portions for tank formation 13*a* and 13*a*, which face opposite each other and a blind tank 14' is constituted from the distended portion for tank formation 14*a* of the formed plate 11 and the distended portion for tank formation 14*a'* of the formed plate 56. With this, since the communicating holes 12 do not communicate between the first tube elements 4 and 4, which clamp the eighth tube element 58, the non intake/outlet tank group 200 is divided into two parts and the heat exchanging medium does not flow between the tank sub groups H and J.

With the structure described above, in addition to the structural features of the laminated heat exchanger 1 in the earlier embodiment, the non intake/outlet tank group 200 is divided into two parts; the left and the right tank sub groups, with the eighth tube element 58 at the center. Consequently, the heat exchanging medium passage group F is divided into two heat exchanging medium passage sub groups $F_1$ and $F_2$ to ensure that the two flows of the heat exchanging medium flow entirely separately until the end.

The first flow path for heat exchanging medium has the heat exchanging medium flowing in from the intake/outlet hole 51 and then being sent from the heat exchanging medium passage 54 to the tank sub group A, which is partitioned by a great number of first tube elements 4 and the plate for intake/outlet portion formation 44 of the intake/outlet tank group 100. In this first path, the heat exchanging medium then travels upward through the heat exchanging medium passage group E of the first tube elements 4 constituting the tank sub group A and then it travels downward before reaching the left end of the non intake/outlet tank group 200. The non intake/outlet tank group 200 is partitioned by the eighth tube element 58 and the heat exchanging medium travels upward from one of the tank sub groups H through the heat exchanging medium passage sub group $F_1$ then downward to reach the tank sub group B of the intake/outlet tank group 100. The heat exchanging medium that has reached the tank sub group B then flows out through the intake/outlet portion 40*b*.

Now, the flow of heat exchanging medium through the second flow path has the heat exchanging medium flowing in from the intake/outlet hole 51, and then travelling through the relay pipe 60 from the heat exchanging medium passage 54 to enter the tank sub group C, which is partitioned by the third tube element 6. The heat exchanging medium that has entered the tank sub group C then travels first upward and then downward through the heat exchanging medium passage group G, and enters the tank sub group J at the right end of the non intake/outlet tank group 200. Once out of the tank sub group J, the heat exchanging medium travels upward and then downward through the heat exchanging medium passage group $F_2$ before reaching the tank sub group B of the intake/outlet tank group 100, where it joins the first flow of the heat exchanging medium described earlier to flow out through the intake/outlet portion 40*b*. In this manner, a so-called 8-pass flow is effected.

Note that, while, in this embodiment, too, the heat exchanging medium flows in through the intake/outlet hole 51 and out through the intake/outlet hole 49, the flow path is not limited to that direction. The heat exchanging medium may enter through the intake/outlet hole 49 and flow out through the intake/outlet hole 51. In that case, the flow of the heat exchanging medium will run in the opposite direction from the arrows in FIG. 14.

Furthermore, the intake/outlet portions 40*a* and 40*b* described earlier do not necessarily have to be constituted by bonding the plates for intake/outlet portion formation 41, 42, 43 and 44 in that order. Although not shown in the figures, the intake/outlet portions 40*a* and 40*b* with the plates for intake/outlet portion formation 41' through 44' which are actually the plates for intake/outlet portion formation 41 through 44 facing the opposite direction, may be used. Note that the structure is identical to that disclosed in the first embodiment except for the assembling direction of the intake/outlet portions 40*a* and 40*b*. The same reference numbers are assigned to identical parts and their explanation is omitted.

Figure 15:
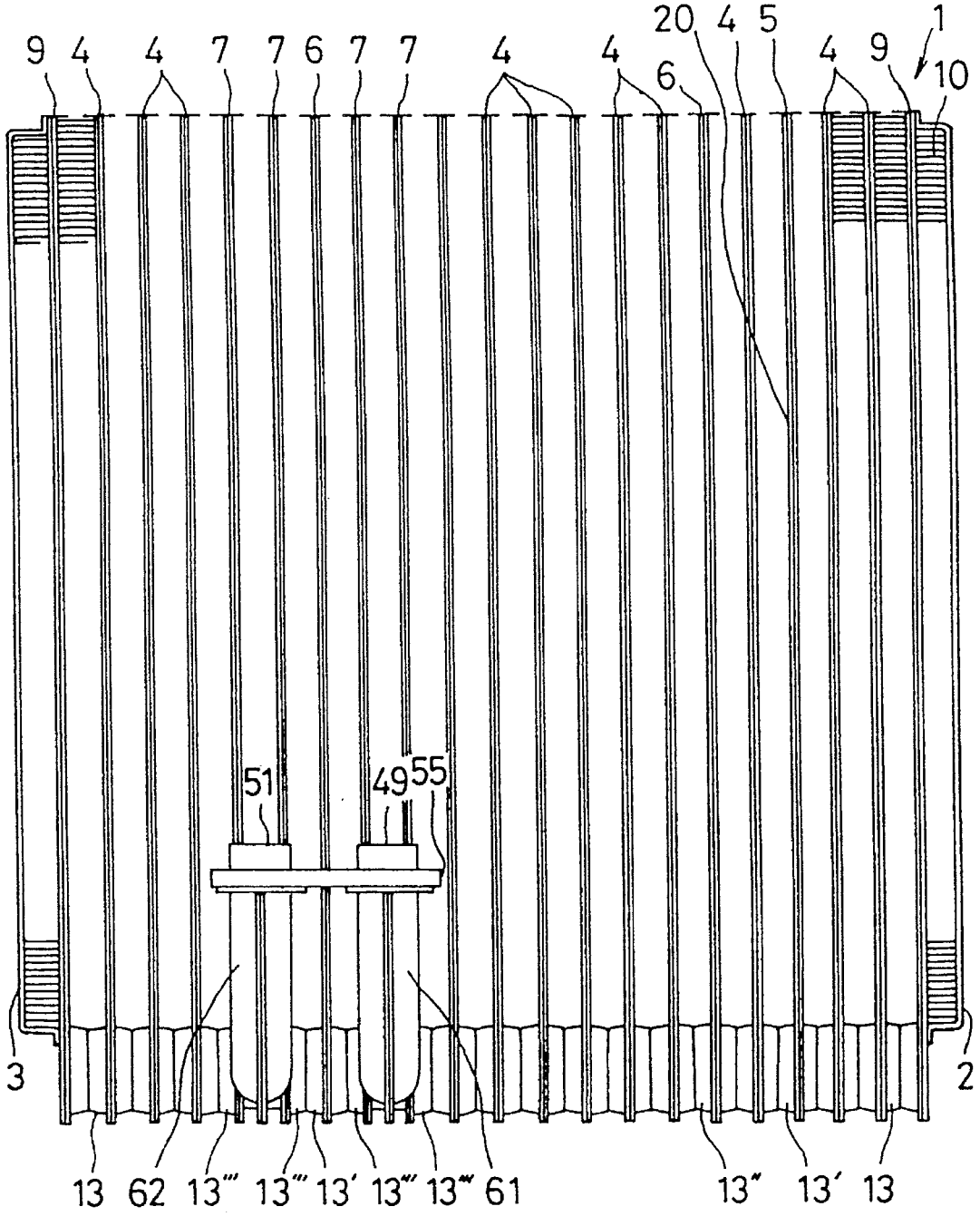
FIG. 15 illustrates the overall structure of the laminated heat exchanger which employs intake/outlet portions structured differently from those in the first embodiment.
Figure 16:
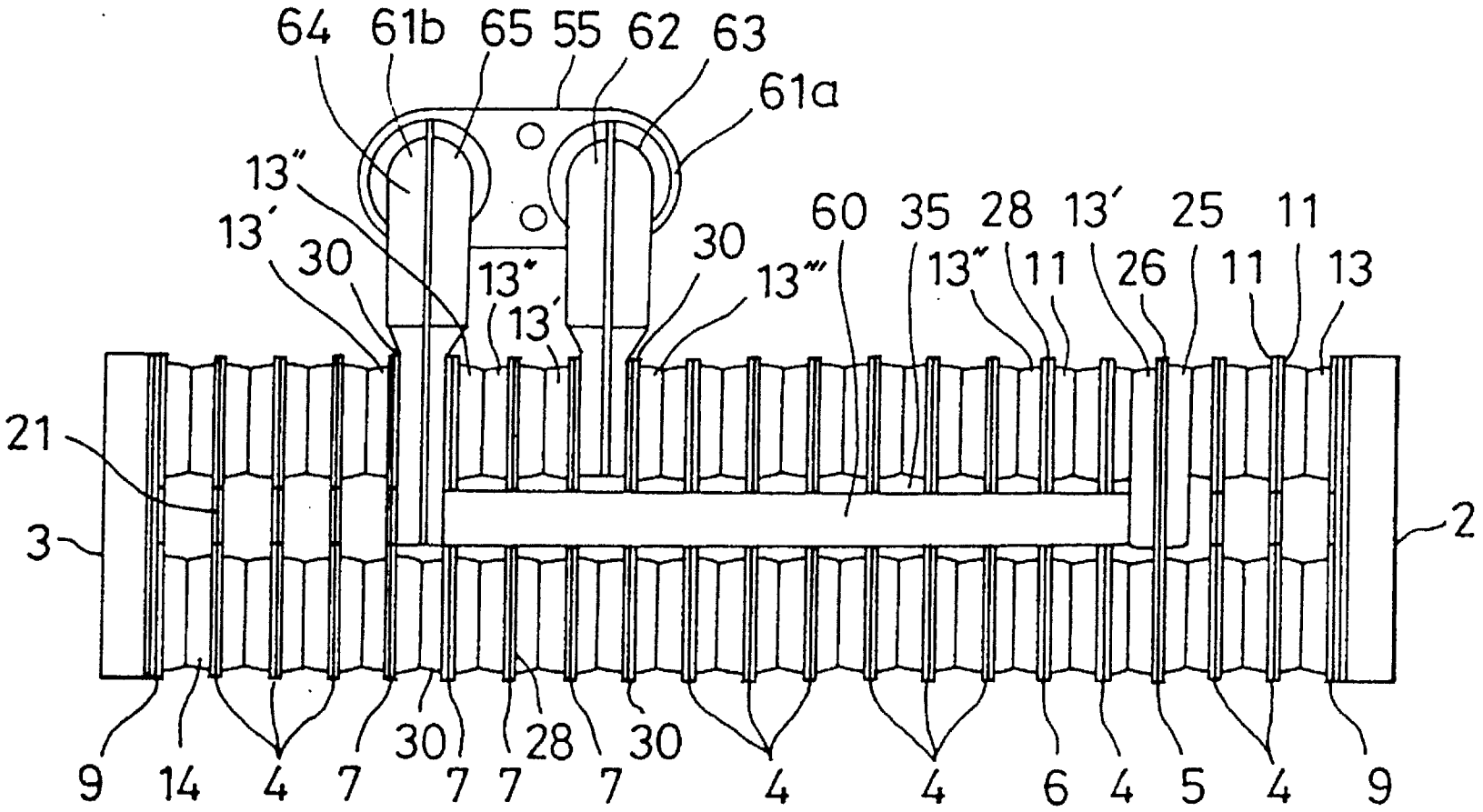
FIG. 16 illustrates the laminated heat exchanger above, viewed from the end with the tanks.

Moreover, instead of assembling the four plates for intake/outlet portion formation 41 through 44 for the intake/outlet portions 40*a* and 40*b*, separate intake/outlet portions may be structured, as shown in FIGS. 15 and 16, i.e., an intake/outlet portion 61*a*, formed by bonding the plates for intake/outlet portion formation 62 and 63 flush to each other and an intake/outlet portion 61*b* formed by bonding the plates for intake/outlet portion formation 64 and 65 flush to each other. In that case, the intake/outlet portion 61*b* must have an extended end projecting to the passage 35 to accommodate bonding to the relay pipe 60 and also must have a fitting hole toward the relay pipe though this is not illustrated.

Figure 17A:
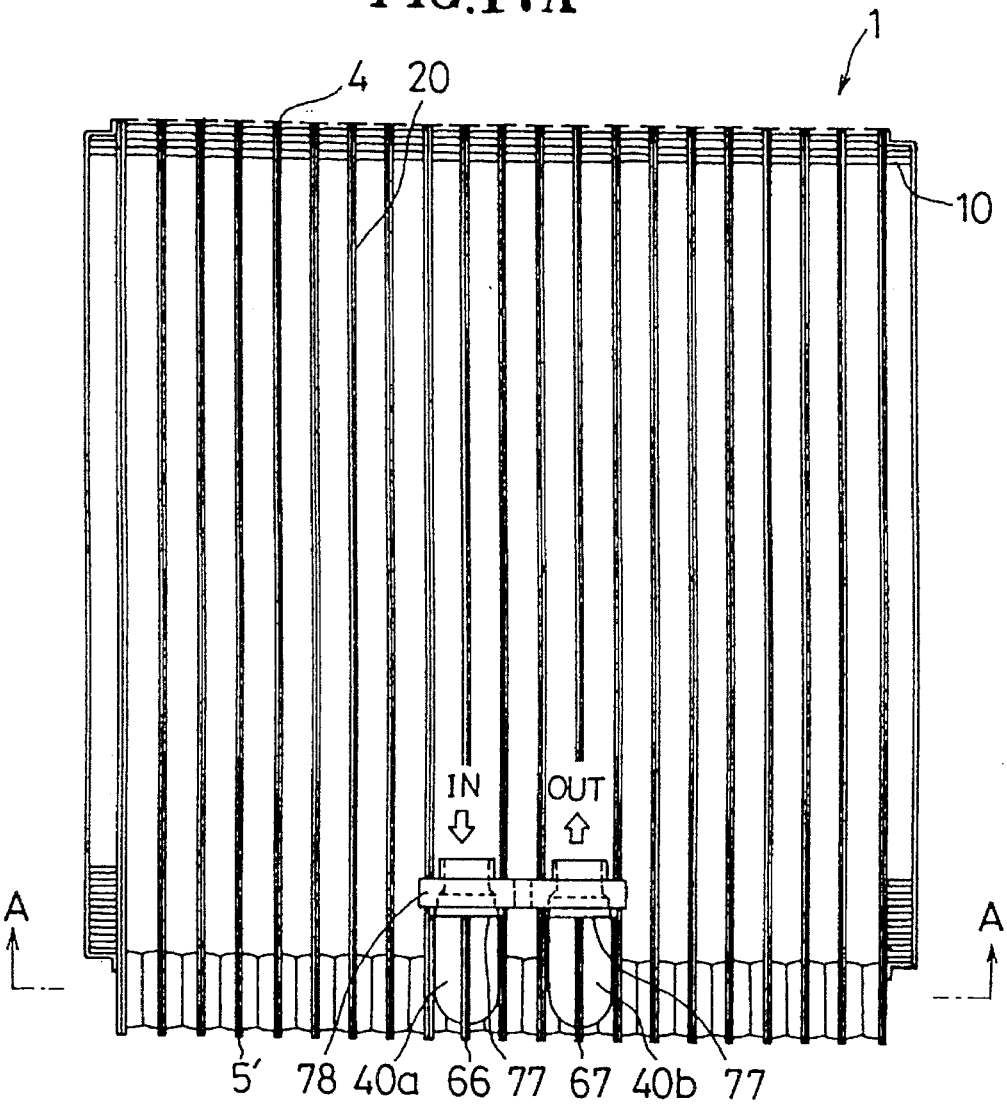
FIGS. 17A and 17B show the laminated heat exchanger in a third embodiment according to the present invention, with FIG. 17A showing a front view and FIG. 17B showing a bottom view.
Figure 17B:
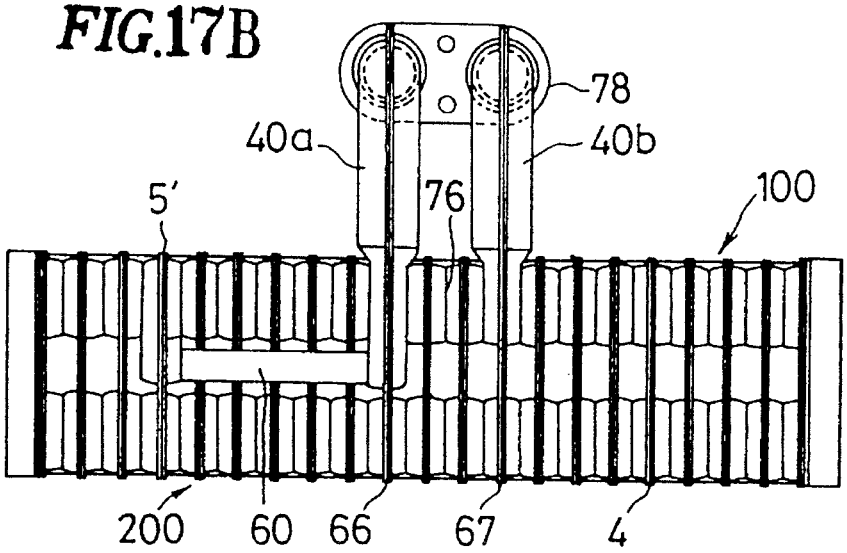
Figure 18A:
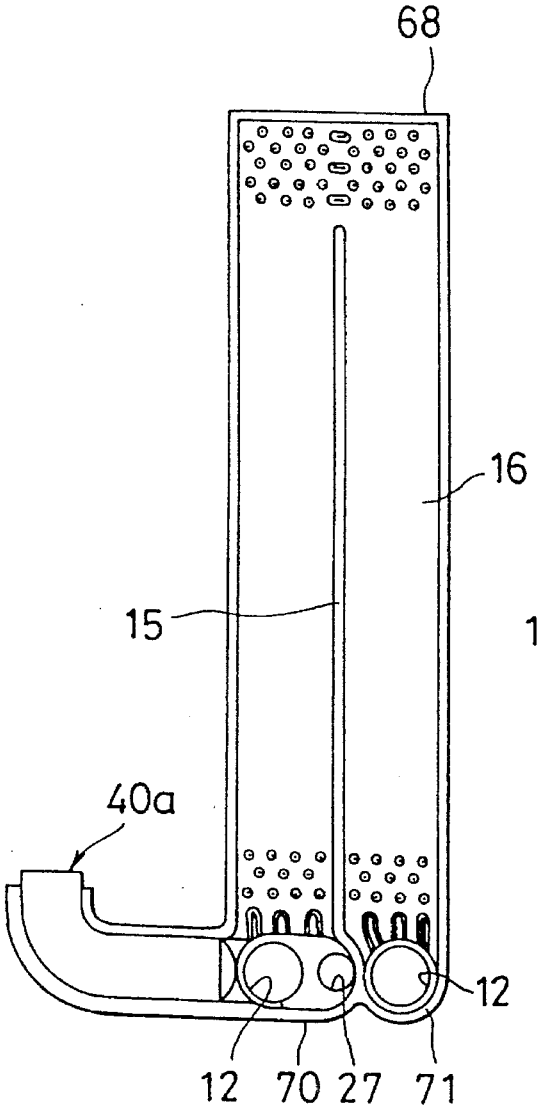
FIGS. 18A and 18B show formed plates constituting tube elements 66 used in the laminated heat exchanger shown in FIGS. 17A and 17B.
Figure 18B:
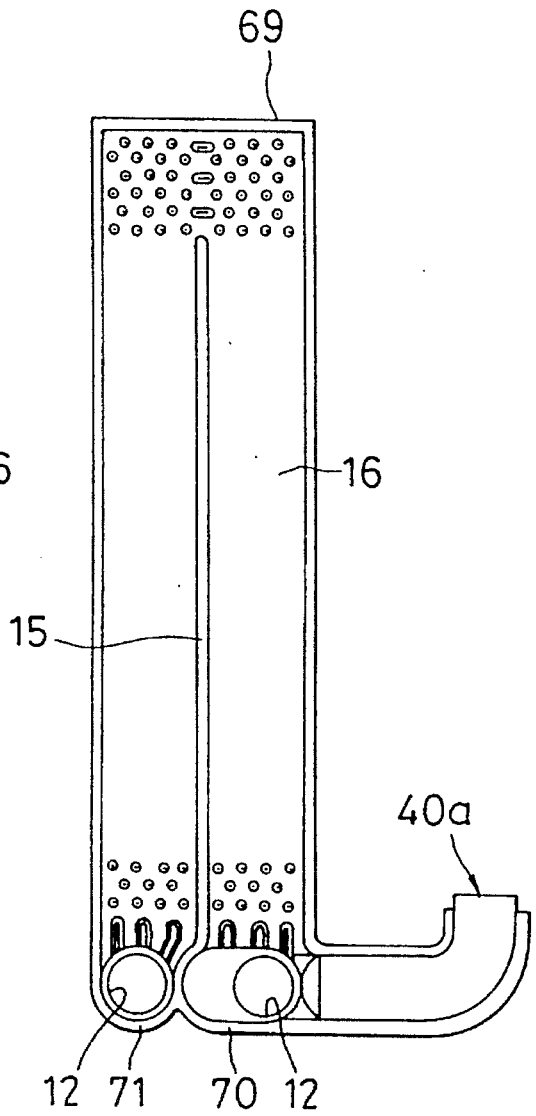

Another embodiment of the present invention is shown in FIGS. 17A and 17B. In this laminated heat exchanger 1, the core of the heat exchanger is formed by laminating the tube elements 4, 5', 66 and 67 alternately with corrugated fins 10 over a plurality of levels with the tube elements 66 and 67 provided at approximately the center in the direction of lamination and end plates 2 and 3 provided at the two ends in the direction of the lamination As explained earlier, the tube element 4 is constituted by bonding two formed plates 11, shown in FIG. 4, flush to each other. The formed plates 68 and 69, constituting the tube element 66, which is provided with one of the intake/outlet portions, have one of the distended portions for tank formation 70 extending in the opposite direction from the other distended portion for tank formation 71 with its end bent upward and opening as shown in FIGS. 18A and 18B. As a result, this tube element 66 is provided with a tank portion that is the same size as that in the tube element 4 described earlier, and another tank portion with an intake/outlet portion 40*a* formed as part of it in the direction of the air flow. In addition, the tank portion provided with the intake/outlet portion 40*a* is expanded so that it is in close proximity with the other tank portion that forms a pair with it, and in one of the formed plates, i.e., formed plate 68, a fitting hole 27 is formed, for connecting a relay pipe 60 to the expanded distended portion for tank formation 70. Note that all other aspects of its structure, i.e., the distended portion for passage formation 16 formed continuously from the distended portions for tank formation 70 and 71, the projection 15 formed extending from between the distended portions for tank formation through the vicinity of the other end of the formed plate and the like, are identical to those of the formed plate 11, shown in FIG. 4, and so their explanation is omitted.

Figure 19A:
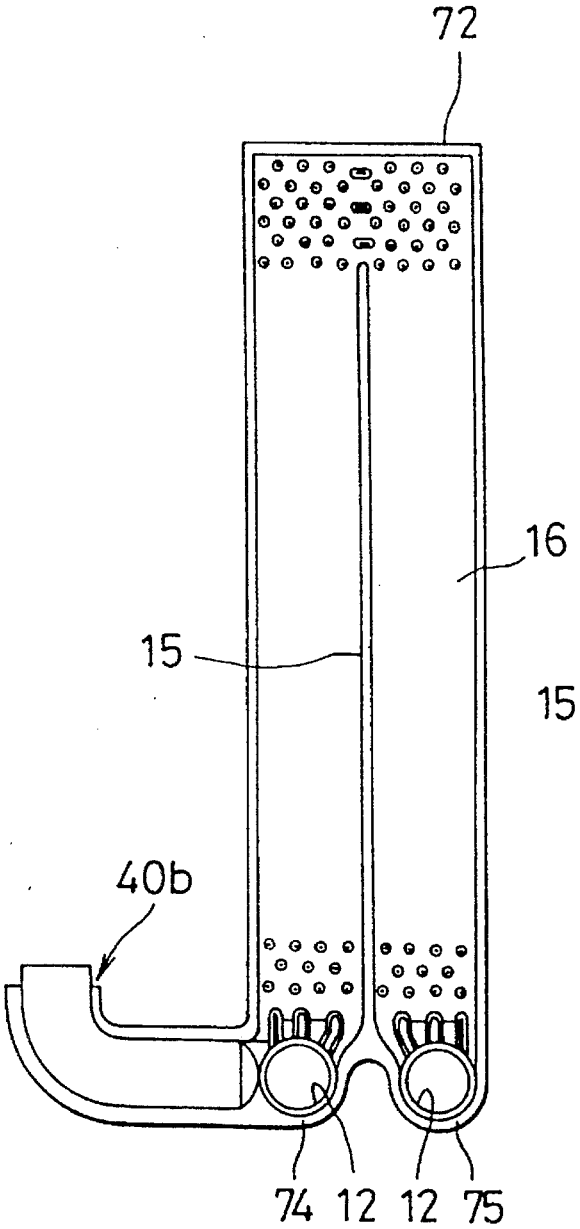
FIGS. 19A and 19B shows formed plates constituting tube elements 67 used in the laminated heat exchanger shown in FIGS. 17A and 17B.
Figure 19B:
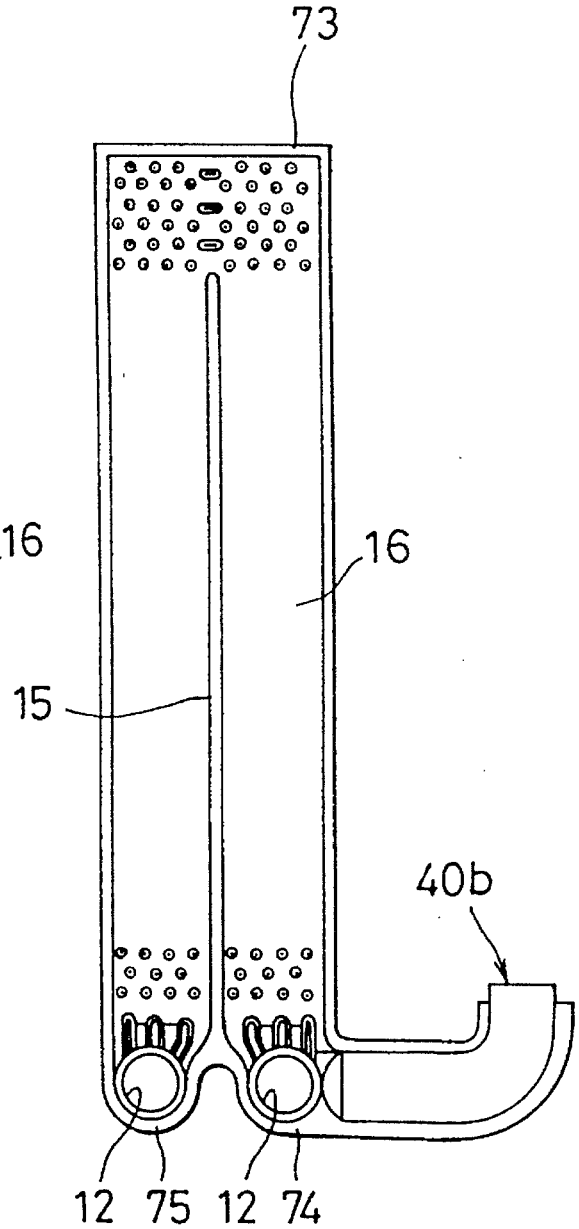

Now, the tube element 67 is formed by bonding formed plates 72 and 73, shown in FIGS. 19A and 19B respectively, facing opposite each other. In each formed plate, the distended portion for tank formation 74, extends out toward the opposite direction from the other distended portion for tank formation 75 with its end opening upward in the figure and the intake/outlet portion 40*b* is formed as a part of it along the direction of the air flow of the tube element. This intake/outlet portion 40*b* is on the same side as the intake/outlet portion 40*a* of the tube element 66 and, as described earlier, all other structural aspects of the formed plates 72 and 73 are identical to those of the formed plate shown in FIG. 4.

These tube elements 66 and 67 are provided on both sides over the non communicating portion 76, which is formed at approximately the center of the intake/outlet tank group 100 and, consequently, the two intake/outlet portions 40*a* and 40*b* are provided in close proximity to each other at approximately the center in the direction of the lamination. Also, a washer 77 which is clad on both surfaces is externally fitted at the end of each of the intake/outlet portions 40*a* and 40*b*, and via these washers 77, a mounting plate 78 for mounting a block type expansion valve is mounted at the ends of both intake/outlet portions.

A tube element 5' is provided toward the end of the tank group, as shown in FIGS. 17A and 17B. It is identical to the tube element that is constituted by bonding the formed plates shown in FIGS. 5 and 6 flush to each other except that a fitting hole 27 is provided in the formed plate on the opposite side.

Each end of the relay pipe 60, which is provided in the passage between the tank sub groups, is bonded into either the fitting hole 27 of the tube element 66 or the fitting hole 27 of the tube element 5' and the tanks toward the intake/outlet tank group of the tube elements 66 and 5' communicate via the relay pipe 60.

Figure 20A:
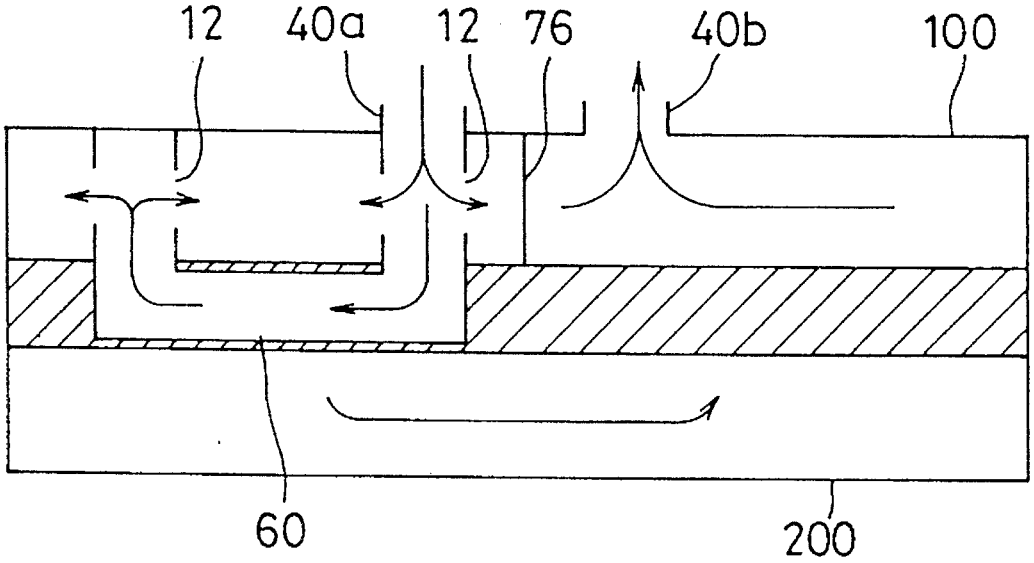
FIG. 20A illustrates the flow of heat exchanging medium in the laminated heat exchanger shown in FIGS. 17A and 17B.

As a result, in this structure, as shown in FIG. 20A, some of the heat exchanging medium which has flowed in through the intake/outlet portion 40*a* on the intake side, travels from the tank portion of the tube element 66 through the communicating hole 12, to flow into the intake side of the intake/outlet tank group 100 and the remaining heat exchanging medium travels through the relay pipe 60 and reaches a tank of the tube element 5', which is far from the intake/outlet portion 40*a* (non communicating portion 76). It then travels from this tank to flow into the intake side of the intake/outlet tank group 100 via the communicating hole 12. The heat exchanging medium that has thus flowed into the intake/outlet tank group then travels upward through the heat exchanging medium passage 20 and makes a U-turn to reach the non intake/outlet tank group. It then moves toward the remaining tube elements, travels upward through the heat exchanging medium passage 20, makes a U-turn again and then reaches the outlet side of the intake/outlet tank group before flowing out through the intake/outlet portion 40*b*.

Consequently, although when the intake/outlet portions 40*a* and 40*b* are provided in close proximity to each other at approximately the center in the direction of the lamination there is a likelihood of the heat exchanging medium flowing near the non communicating portion 76 and not being supplied toward the end, at least on the intake side, the heat exchanging medium flows in through two locations, i.e., near the non communicating portion 76 and toward the end of the intake/outlet tank group, making it possible to disperse the heat exchanging medium throughout the entirety of the tank sub group on the intake side and to promote the distribution of the heat exchanging medium.

Figure 20B:
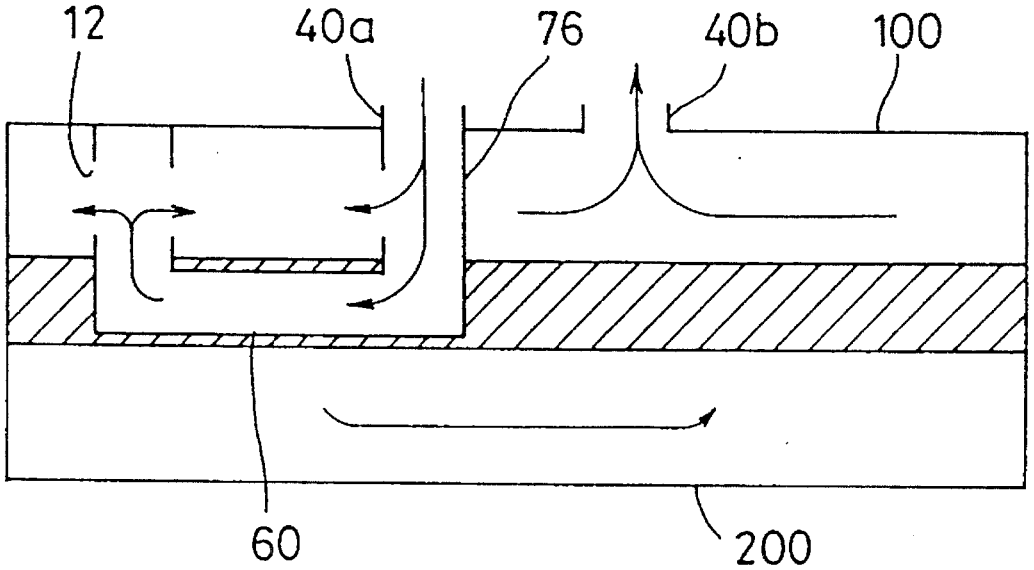
FIG. 20B illustrates the flow of heat exchanging medium effected when a non-communicating portion 76 is substituted with an intake/outlet portion 40*a;*

Note that, while, in this embodiment, the non communicating portion 76 of the intake/outlet tank group is constituted by not providing a communicating hole 12 in the tube element 4 which is located between the intake/outlet portions, or by blocking the communicating hole 12 which is formed in that area, the non communicating portion may be constituted instead, for instance, as shown in FIG. 20B, by not forming a communicating hole 12 in the formed plate 69 which constitutes the intake/outlet portion 40*a* on the intake side, or constituted with the tank, which is provided with the intake/outlet portion 40*a* itself, while blocking the communicating hole 12 of the formed plate 69. Moreover, the intake/outlet portion 40*b* on the outlet side too, may communicate at two locations effected by the relay pipe as in the case of the intake/outlet portion on the intake side. Both sides being structured identically in this manner can support the flow of heat exchanging medium in which the intake and the outlet are reversed.

Figure 21A:
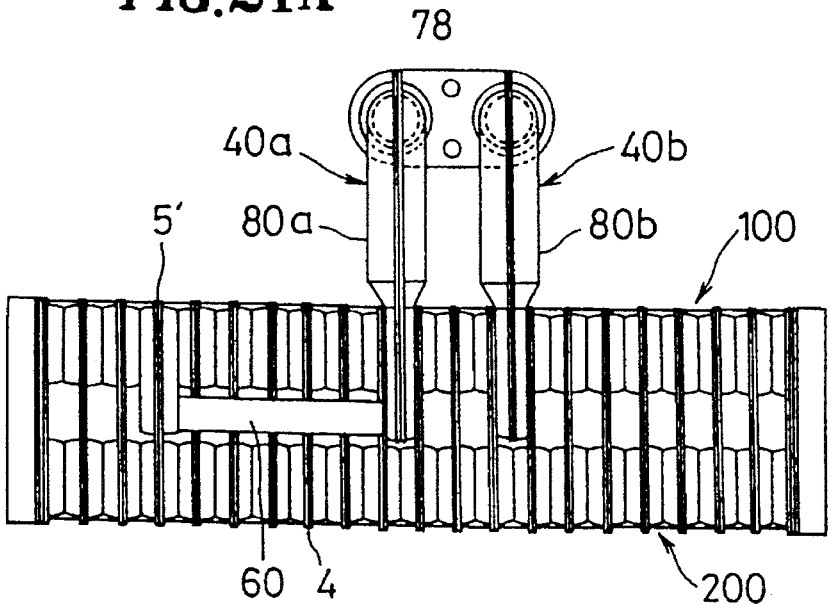
FIGS. 21A and 21B show another mode of the laminated heat exchanger in the third embodiment, with FIG. 21A showing a bottom view and FIG. 21B showing members constituting the intake/outlet portions.

Heat exchanging medium can flow in at two separate locations on the intake side of the intake/outlet tank group in a structure shown in FIG. 21A in which the intake/outlet portions 40*a* and 40*b* are constituted with pipes 80*a* and 80*b* provided between the tube elements, as well as in the structure described above, in which the intake/outlet portions are formed as part of the tube elements.

Figure 21B:
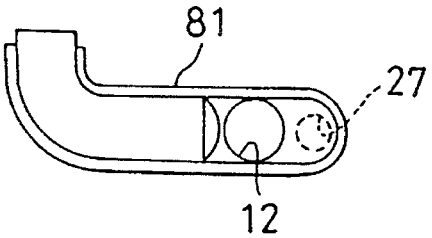

Each of the pipes 80*a* and 80*b* is constituted by bonding two pipe forming members 81, as shown in FIG. 21B, flush to each other. A communicating hole 12 that communicates with adjacent tanks is formed in the base portion, which is enclosed between the tube elements, and the portion that extends out from the heat exchanger core in the direction of the air flow, is bent upward and opens. A mounting plate 78 for an expansion valve is attached at its end via a washer. Also, the base portion of each pipe projects out between the tank groups and in the pipe 80*a* on the intake side, a mounting hole 27 (indicated with the broken line in FIG. 21B), in which the relay pipe 60 is bonded, is formed in this projected portion.

The relay pipe 60 is connected into the fitting hole 27 of the pipe 80*a* and the fitting hole 27 of the tube element 5' so that the heat exchanging medium flowing in through the intake/outlet portion 40*a* can flow in from two locations as in the case of the embodiment described earlier.

Figure 22:
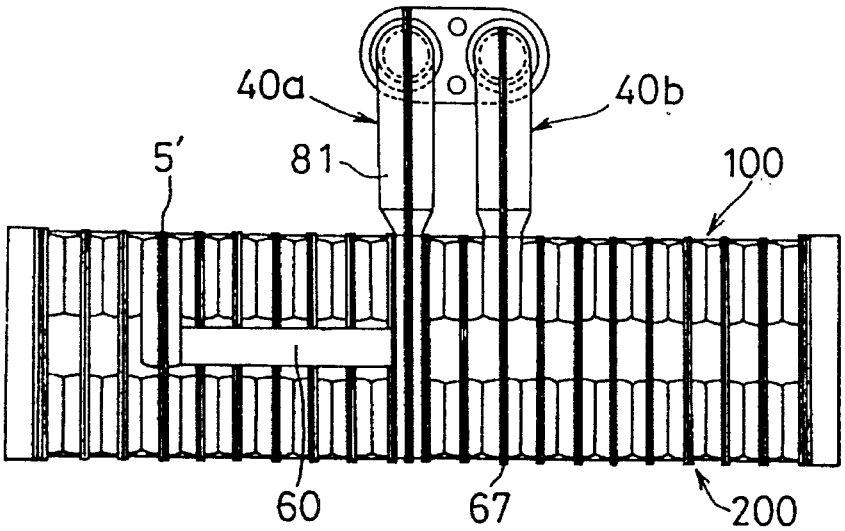
FIG. 22 shows yet another mode of the laminated heat exchanger in the third embodiment.

Yet another structural possibility is shown in FIG. 22, in which one intake/outlet portion 40*a* is constituted with a 2-way split pipe and the other intake/outlet portion 40*b* is constituted as an integrated unit which includes the tube. To be more specific, the intake/outlet portion 40*a* on the intake side may be constituted by combining two split members to achieve a pipe-like form and the base end portion of the pipe 81 is fitted in such a manner that it is clamped by the tube elements adjacent to it. This base portion and the adjacent tanks are made to communicate via the communicating hole as necessary. The base portion, which is mounted between the tube elements, has a different structure from that shown in FIGS. 21A and 21B. Its length matches the width of the core main body in the direction of the air flow. As a result, no distended portion for tank formation is formed in the area where the pipe 81 is mounted. In contrast, the intake/outlet portion 40*b* on the outlet side has a structure that is identical to that of the tube element 67 used in the intake/outlet portion 40*b*, shown in FIGS. 17A and 17B.

In these other structures, too, since the heat exchanging medium that flows in through the relay pipe 60 is sent to the vicinity of the end of the tank sub group, at least on the intake side of the intake/outlet tank group 100, as in the case of the embodiment shown in FIGS. 17A and 17B, distribution of the heat exchanging medium is effective and an improvement in heat exchanging efficiency can be achieved.

As has been explained, according to the present invention, a six- or eight-pass flow of the heat exchanging medium is formed overall, and the heat exchanging medium is made to flow along two separate paths from the intake to the outlet. As a result, the area where the heat exchanging medium flows is expanded compared to the 4-pass flow system in the prior art, ensuring that the heat exchanging medium reaches every part of the laminated heat exchanger, improving the heat exchanging efficiency and, as a result, enhancing the performance of the heat exchanger.

Also, according to the present invention, even when constituting a 4-pass flow system, the intake/outlet portions are each structured with a 2-way split pipe that is formed as part of the tube element or as a part separate from the tube element, to ensure that the heat exchanging medium that flows in from the intake/outlet portion flows directly into the intake/outlet tank group while heat exchanging medium flows in from another location as well, via the relay pipe. Consequently, the heat exchanging medium that has flowed in can spread through the entirety of the intake/outlet tank group on its intake side and with the heat exchanging medium flowing to every corner of the heat exchanger, the heat exchanging efficiency is improved.

What is claimed is:

1. A laminated heat exchanger constituted by a plurality of tube elements and a plurality of sets of fins alternately laminated with said tube elements, each of said tube elements being constituted by two formed plates fitted together and having a pair of tanks at one end and a heat exchanging medium passage communicating between said tanks, said tanks of said plurality of tube elements constituting an intake/outlet tank group and a non-intake/outlet tank group separate from said intake/outlet tank group;

wherein said intake/outlet tank group is divided into first and second tank sub-groups by a non-communicating portion provided at approximately a center of said intake/outlet tank group in a direction of lamination;

wherein said non-intake/outlet tank group is a single group of tanks, undivided by partitions, which are in communication with one another;

wherein a first intake/outlet portion is provided in said first tank sub-group and a second intake/outlet portion is provided, across said non-communicating portion from said first intake/outlet portion, in said second tank sub-group;

wherein said first intake/outlet portion communicates, via a fluid relay member, with a tank of said first tank sub-group which is located further from said non-communicating portion than said first intake/outlet portion; and wherein a passage is formed between said intake/outlet tank group add said non-intake/outlet tank group, and said fluid relay member is disposed in said passage.

2. A laminated heat exchanger according to claim 1, further comprising washers externally fitted on distal ends of said first and second intake/outlet portions, respectively; and an expansion valve mounting plate attached via said washers, to said distal ends of said first and second intake/outlet portions.

3. A laminated heat exchanger according to claim 1, wherein for adjacent tanks which are in communication with one another, communicating holes are formed in said tanks for fluidically communicating the adjacent tanks; and each of said non-communicating portions is constituted by either a wall of one of said tanks which has no communicating hole formed therein, a blocking member or a wall of one of said first and second intake/outlet portions.

4. A laminated heat exchanger according to claim 3, wherein said first and second intake/outlet portions and said tank sub-groups are arranged such that heat exchanging medium flows directly from said first intake/outlet portion into said first tank sub-group at a first location and also flows from said first intake/outlet portion via said relay member into said first tank sub-group at a second location, then, after the heat exchanging medium spreads through said first tank sub-group, it travels away from the tanks of said first tank sub-group of said intake/outlet tank group through said heat exchanging medium passages of respective ones of said tube elements which include said tanks of said first tank sub-group of said intake/outlet tank group, then travels toward the tanks of said non-intake/outlet tank group through said heat exchanging medium passages of the respective ones of said tube elements which include said tanks of said first tank sub-group of said intake/outlet tank group, then travels into the tanks of said non-intake/outlet tank group which are contained in the tube elements having the tanks of said second tank sub-group of said intake/outlet tank group, then travels away from said tanks of said non-intake/outlet tank group into said second tank sub-group of said intake/outlet tank group through said heat exchanging medium passages of respective ones of said tube elements which include said tanks of said second tank sub-group, and then flows out from said second intake/outlet portion.

5. A laminated heat exchanger according to claim 1, wherein each of a given number of said tube elements has an indented portion formed at said one end between said pair of tanks so as to constitute said passage; and said fluid relay member comprises a relay pipe positioned in said passage.

6. A laminated heat exchanger according to claim 1, wherein each of said first and second intake/outlet portions is constituted as part of a respective one of said tube elements.

7. A laminated heat exchanger according to claim 1, wherein each of said first and second intake/outlet portions is constituted by a 2-way split pipe.

* * * * *